US005915871A

United States Patent [19]

Kobayashi et al.

[11] Patent Number: 5,915,871

[45] Date of Patent: Jun. 29, 1999

[54] BALL-POINT PEN CAP

[75] Inventors: Seiichi Kobayashi, Yokohama; Kazuhiko Furukawa, Kouza-gun; Hiroaki Koyama, Yokohama; Toru Kitao, Sagamihara, all of Japan

[73] Assignee: Mitsubishi Pencil Kabushiki Kaisha, Tokyo, Japan

[21] Appl. No.: 08/927,361

[22] Filed: Sep. 9, 1997

Related U.S. Application Data

[62] Division of application No. 08/501,077, Aug. 4, 1995, Pat. No. 5,711,626, which is a continuation of application No. PCT/JP94/02040, Dec. 5, 1994.

[30] Foreign Application Priority Data

| | | | |
|---|---|---|---|
| Dec. 6, 1993 | [JP] | Japan | 5-71098 |
| Dec. 6, 1993 | [JP] | Japan | 5-71099 |
| Feb. 28, 1994 | [JP] | Japan | 6-52601 |
| Feb. 28, 1994 | [JP] | Japan | 6-52603 |
| Mar. 16, 1994 | [JP] | Japan | 6-70163 |
| Mar. 16, 1994 | [JP] | Japan | 6-70165 |
| Apr. 12, 1994 | [JP] | Japan | 6-97034 |
| Apr. 22, 1994 | [JP] | Japan | 6-106274 |

[51] Int. Cl.[6] ..... B43K 23/08; B43K 23/12

[52] U.S. Cl. ..... 401/213; 401/202; 401/243; 401/246

[58] Field of Search ..... 401/202, 213, 401/243, 246

[56] References Cited

U.S. PATENT DOCUMENTS

| | | | |
|---|---|---|---|
| 680,117 | 8/1901 | Boman | 401/243 |
| 1,689,569 | 10/1928 | Walerowiez | 401/246 X |
| 2,676,349 | 4/1954 | Vosburg | 401/202 |
| 5,316,402 | 5/1994 | Wakai et al. | 401/243 X |

FOREIGN PATENT DOCUMENTS

| | | | |
|---|---|---|---|
| 25991 | 2/1990 | Japan | 401/243 |
| 39878 | 1/1991 | Japan | 401/243 |

*Primary Examiner*—Steven A. Bratlie
*Attorney, Agent, or Firm*—Darby & Darby

[57] ABSTRACT

A pen cap having at least two engaging portions (**59*f*, 59*r*) specifically adapted to engage a receiving-side engaging portion (51*f*) formed on the mouthpiece-side end (7) of a hollow barrel and a receiving-side engaging portion (51*r*) formed on the tail-plug-side end of the hollow barrel (9**), respectively. The engaging portions on the cap are at different locations along the cap's longitudinal axis. Furthermore, the engaging portions on the cap have their engaging surfaces disposed radially outward at different distances relative to the cap's longitudinal axis.

1 Claim, 37 Drawing Sheets

BALL-POINT PEN CAP

This is a division, of application Ser. No. 08/501,077, filed Aug. 4, 1995 now U.S. Pat. No. 5,711,626, which is a continuation of International application Ser. No. PCT/JP94/02040, filed Dec. 5, 1994.

TECHNICAL FIELD

The present invention relates to a ball-point pen. The invention, in particular, relates to a ball-point pen equipped with a back leakage preventing mechanism for preventing a so-called back leakage phenomenon that, when a ball-pen is used to write with its tip up, air-bubbles enter the refill through channels between a ball and its holder thereby causing ink to flow toward the backside of the ball.

BACKGROUND ART

A ball-point pen holds, at its front end, a small ball which receives frictional forces as writing and rotates on paper, to thereby draw ink out of a tube and transfer it onto the sheet.

As shown in FIG. 39, a structure 'a' of a writing portion in a ball-point pen is generally composed of a ball 'b' and a holder 'd' rotatably holding the ball 'b' on a socket seat 'c'. This assembly made of the ball 'b' and the holder 'd' is called a tip 'e'. The tip 'e' is connected with an unillustrated refill as an ink reservoir, so that ink is supplied to the ball 'b'.

Meanwhile, the ball-point pen accidentally becomes incapable of writing even with sufficient ink remaining in the refill. This kind of happening can be attributed to the following four causes:

1) One possible case is that ink is hardened from time-worn effects or metal surfaces inside the tip 'e' are corroded whereby the rotation of the ball 'b' is disturbed. This is liable to happen when the pen has been left unused for a prolonged period of time.
2) A case where the ball-point pen is used excessively and the ball 'b' is worn out and deformed so as to disturb smooth rolling of the ball 'b', or excessive use deforms a hold 'g' at the front end of the ball socket seat in the holder 'd' thereby inhibiting the rotation of the ball 'b'.
3) A case where, when the pen with dust and dirt collected in clearance 'h' between the holder 'd' and the ball 'b' has been left for a prolonged period of time, these dust and dirt induce ink to dry and stick to the ball 'b' and the holder 'd', whereby the rotation of the ball 'b' is disturbed.
4) A case where a gap is formed between the ball 'b' and the ink in the refill and air enters the gap. In this case, the ball 'b' itself can rotate, unlike the aforementioned cases 1) to 3) in which ink cannot come out due to the obstruction to the rotation of the ball 'b'. Nevertheless, because the ball 'b' is not in contact with ink, the ball 'b' rotates in vain and cannot bring the ink which is in the refill to the paper surface. Such an idle rotation is liable to occur when the pen is used to write with its tip up. In this case, when the ball 'b' uses up the ink therearound, the ink in the refill does not follow the rolling of the ball 'b', whereby a gap is created between the ball 'b' and the ink. Accordingly, however does the ball 'b' rotate, the ink in the refill will not come out. To make matters worse, when upward writing is done, air enters the refill through the clearance 'h' between the ball 'b' and the holder 'd' and the ink flows toward the opposite direction to the ball 'b', causing a back leakage.

A main object of the present invention is to provide a ball-point pen capable of preventing the back leakage which is liable to occur when upward writing is done.

Other objects of the present invention will be apparent from a reading of the following detailed description with reference to the accompanying drawings.

DISCLOSURE OF THE INVENTION

1. A ball-point pen has a ball-point pen refill which comprises: a tip rotatably holding a writing micro-ball fitted by press-forming at a front end thereof; an ink storing pipe storing ink; and is constructed such that a joint connecting the tip with the ink storing pipe, the joint is formed with a tip-side bore and an ink-storing-pipe-side bore for allowing ink to pass therethrough when the tip and the ink storing pipe are fitted into the joint; the tip-side bore and ink-storing-pipe-side bore are communicated by a communicating hole which is composed of a large-diameter portion and a small-diameter portion connected to the tip-side bore and the ink-storing-pipe-side bore, respectively; and a large ball having a greater diameter than a bore diameter of the small-diameter portion is disposed freely movably in at least a part of a space formed between the rear end of the tip and the large diameter portion when the tip is fitted into the tip-side bore. Hence, when writing is done normally with the pen tip down, the large ball moves toward the pen-tip-side end inside the at-least-a-part of the space so as to open the communicating hole. As a result, the ink storing pipe and the tip become communicated, so that the ink stored in the ink storing pipe moves toward the tip through the communicating hole. At that time, since the large ball is disposed freely movably in the at-least-a-part of the space, ink from the ink storing pipe moves to the tip side through channels formed between the large ball and the inner side of the large-diameter portion or/and the inner side of the ink-storing-pipe-side bore. In contrast, when writing is done with the tip up, the large ball moves toward the small-diameter portion of the communicating hole from the pen-tip-side end in the at-least-one-part of the space. As the large ball has a greater diameter than the inside diameter of the small-diameter portion, the large ball, reaching the small-diameter portion, blocks the hole of the small-diameter portion, so that the communicating hole is closed. Accordingly, since the large ball moves to the small-diameter-portion side when upward writing is done, if the outside air flows into the refill through micro-clearances between the writing micro-ball held at the front end of the tip and the tip, the ink storing pipe is confined from the outside air, as if, for example, one opening of a straw with a liquid therein were sealed by a finger. Hence, it is possible to prevent back leakage phenomenon from occurring. In this way, the communicating hole is provided for the joint connecting the ink storing pipe and the tip, and the large ball is disposed freely movably within a passage of the communicating hole, which shifts from one site to the other of the passage in accordance with the downward use or the upward use of the ball-point pen whereby the passage is opened or blocked. As a result, a back leakage preventing valve as a back leakage protecting device is created inside the joint.

2. Since the communicating hole is made eccentric to the tip-side bore and the ink-storing-pipe-side bore, improved flow of ink can be established when downward writing is done.

3. Since the joint is constructed in a form of a hollow sleeve having a flange in the middle portion with respect to the lengthwise direction of it and a half of the joint divided by the flange has the ink-storing-pipe-side bore and constitutes a squeezing pipe portion to be squeezed into the front part of the ink storing pipe, while the other half divided by the flange has the tip-side bore and constitutes a fitting pipe portion fitted to the mouthpiece, the flange abuts the front end of the ink storing pipe when the squeezing pipe portion of the joint is squeezed into the ink storing pipe of the ball-point pen refill, whereby the joint is positioned relative to the ink storing pipe.

Further, since a plurality of slant ribs are formed between the fitting pipe portion and the flange, the mouthpiece has a stepped bore formed thereinside by drilling in conically stepped formation and one ridge at least one step of steps of the stepped bore is engaged with the slant ribs in a biting manner; it is possible for the tip not to sway when the ball-point pen refill with its ink storing pipe of the ball-point pen refill inserted in the hollow barrel is fixed by the mouthpiece.

4. Since the joint and the hollow barrel are formed with a resin of the same color with ink used and a transparent resin, respectively, even if the ink is used up and the color of ink that used to be in the ink storing pipe became unknown, it is possible to check the joint of the same color with the ink through the transparent hollow barrel from the outside. Accordingly, a user will never be puzzled to replace the used refill with a new ball-point pen refill of the ink having the same color as in the used refill.

5. Since separate engaging portions are formed at different sites with respect to the axial direction of the cap on the inner peripheral surface thereof near to an opening thereof and one of the engaging portions is engaged with a receiving-side engaging portion formed on the mouthpiece-side end of the hollow barrel while the other engaging portion is engaged with another receiving-side engaging portion provided on the tail-plug-side end of the same hollow barrel, the individual engaging portions on the cap are dedicatedly allotted to the receiving-side engaging portion formed on the mouthpiece-side end and the receiving-side engaging portion formed on the tail-plug-side end, respectively. Therefore, it is possible to improve the durability of the engaging portions as compared to a cap formed with a single engaging portion.

6. Since the tip comprises: a writing micro-ball; a hollow holder having a ball socket seat rotatably holding the writing micro-ball at a front end thereof fitted by press-forming and a bore tapered toward the front end thereof with an opening at the rear end thereof; and an elastic member providing resilient forces on the writing micro-ball from the backside thereof, the writing micro-ball abuts the press-formed inner side of the ball socket seat by virtue of the elastic force of the elastic member so as not to come out from the ball socket seat. Accordingly, it is possible to prevent occurrence of so-called forward leakage as to be the natural falling phenomenon due to the gravity acted on ink when the pen tip is down. Besides, since the elastic member is formed at a front end thereof with a conical portion in fit with the bore shape of the hollow holder, stability of the elastic member inside the hollow holder improves, whereby it is possible to establish a good contact between the writing micro-ball and the elastic member.

7. Since a pushing rod member composed of a rod-like portion abutting the writing micro-ball and a base connected to an elastic member is formed separately from the elastic member and attached at a front end of the elastic member, the base can move relative to the elastic member. As a result, the swaying performance of the rod-like portion improves, and it becomes possible to make the writing micro-ball fit with the rod-like portion.

8. Since the joint is formed of a resiliently deformable synthetic resin while a narrow part is formed between the tip-side bore and the large-diameter portion as a part of the communicating hole of the joint, the narrow portion can easily be expanded when the large ball is inserted into the communicating hole of the joint. As a result, the assembling of the large ball to the joint is made easy, so that the improvement of the assembling work can be expected. Further, since the inside diameter of the narrow part is set smaller than the diameter of the large-ball, there is no possibility that the large ball comes out from the hole defined by the narrow part. Accordingly, the large ball inserted in the communicating hole moves within a range formed by the hole defined by the narrow part and the front end of the small-diameter as a part of the communicating hole near to the side of the large-diameter portion. Further, since the narrow part makes narrow the tip-side bore near to the side of the large-diameter portion, if the spring to be inserted into the hollow holder is designed to be somehow longer than the hollow holder and the rear end of the spring is adapted to abut the narrow part when the spring is inserted into the tip-side bore of the hollow holder, the spring is contracted between the narrow part and the writing micro-ball that is prevented from falling off the ball socket seat by the press-formed part, to thereby exert resilient forces. For this reason, the writing micro-ball becomes pressed resiliently all the time. At that time, if critical factors for determining the resilient force acted on the writing micro-ball, such as the length of the elastic member, the position of the narrow part etc., are properly set up so that the resilient force on the writing micro-ball may be weaker to some extent than the writing pressure required for writing, no harmful effect against writing does occur and this rather facilitates the pen to realize smooth, comfortable writing in conformity with the surface roughness of the paper.

9. Since the ball-point pen has the tip which is produced by press-forming at least a part of the rear end of the hollow holder after the elastic member is inserted into the holder, the spring will never pop out from the hollow holder when the tip is fitted into the tip-side bore of the joint, whereby the assembling can be simplified.

10. Since a piece which has an ink channel thereinside and is fitted in the tip-side bore is fixedly arranged between the tip in the tip-side bore and the large-diameter portion of the communicating hole, the large ball moves freely in a range defined by the front end of the small-diameter as a part of the communicating hole near to the side of the large-diameter portion and the piece. Accordingly, when normal writing is done with the pen tip down, ink stored in the ink storing pipe moves toward the tip through the ink channel inside the piece. Since the arrangement of the piece in the tip-side bore defines the range within which the large ball is freely movable, the tip-side bore is formed in more simplified manner since there is no need for creating a narrow part, than in the case where the large ball is allowed to freely move in a range between the hole defined by the narrow part and the front end of the small-diameter as another part of the communicating hole.

11. Since a spring as the elastic member is set longer than the hollow holder of the tip while the rear end of a coil portion of the spring is bent so as to be in parallel with a diameter of the coil portion, the tip-side bore is formed greater in diameter than the large-diameter portion so as to form a stepped portion in a boundary part between the tip-side bore and the large-diameter portion, and the tip is joined to the joint having the stepped portion inside the communicating hole thereof; if the tip is fitted into the tip-side bore of the communicating hole, the rear end of the spring abuts the footstep surface of the stepped portion and the spring is contracted between the footstep surface and the writing micro-ball to exert resilient forces. Hence, the writing micro-ball becomes pressed resiliently all the time. At that time, if critical factors for determining the resilient force acted on the writing micro-ball, such as the length of the spring, the position of the footstep surface etc., are properly set up so that the resilient force on the writing micro-ball may be weaker to some extent than the writing pressure required for writing, no harmful effect against writing does occur and this rather facilitates the pen to realize smooth, comfortable writing in conformity with the surface roughness of the paper. Since the rear end of the coil portion is bent so as to be parallel to a diameter of the coil portion, when downward writing is done, the large ball abuts the rear end of the coil portion, so that the movement of the large ball is limited. Accordingly, the large ball will freely move in a range formed by the bent rear end and the aforementioned large-diameter portion.

12. Since the inner side of the tip-side bore is formed with a groove extending from the large-diameter portion toward the tip, an increasing amount of ink is supplied to the pen tip through the groove when normal writing is done with the pen tip down.

13. Since a greasy follower which moves inside the ink storing pipe following the ink stored in the ink storing pipe is put in the ink storing pipe so as to abut the rear surface of the ink, it is possible for the follower to prevent ink from evaporating and flowing out from the tail-plug side of the ink storing pipe. Further, when upward writing is done, if the writing micro-ball used up the ink therearound to thereby create a space between the writing micro-ball and the ink, the ink head would become high and the back leakage phenomenon would be liable to occur. However, since the follower is placed on the rear surface of the ink, it is possible to inhibit the back leakage phenomenon by virtue of the viscosity of the follower.

14. Since a rod member which has a smaller diameter than the inside diameter of the ink storing pipe and the same specific gravity with that of the follower is buried in the follower, it is possible to inhibit so-called liquid flapping due to impacts caused by falling etc. Besides, since the follower rod as to be a solid serves as a skeleton for the greasy follower rather akin to liquids, the follower itself is stabilized and consequently, it is possible to prevent the back leakage phenomenon as well as to prevent the ink from evaporating and flowing out in a more effective manner than when the follower is used alone.

15. Since air passages are complexly formed like a maze in the tail plug along the circumferential direction and the axial direction of the tail plug, it is possible to prevent the ink from evaporating and the follower from drying.

16. Since the spring is composed of a conical coil portion reduced in diameter toward the front end thereof and a straight portion extending, when the spring is inserted in the hollow holder, from the front end of the coil portion toward the writing micro-ball held by the ball socket seat of the hollow holder, hitches of the spring on the inside conically stepped bore of the hollow holder can be decreased and the workability of assembling can be improved.

17. Since a thixotropic ink is used which presents a high viscosity in a static state where the ball-point pen is unused but lowers its viscosity in a dynamic state where the ball-point pen is used with the writing micro-ball rotating on the surface of paper, even if, for example, the ball-point pen without cap is placed in a breast pocket with its tip up and the writing micro-ball at the front end popping out from the pocket comes in touch with the collar etc., as if upward writing were done, a slight, limited rotation of the writing micro-ball occurring when the wiring micro-ball comes in contact with the collar etc., is unlikely to cause back leakage phenomenon. Accordingly, clothes and the like are hardly polluted. On the other hand, in a case where downward writing is done, when the pressed state between the writing micro-ball and the ball socket seat is released by the writing pressure and the writing micro-ball rolls on the surface of paper, the thixotropic ink will be easily drawn out onto the paper surface. Consequently, the ball-point pen is considered as to be easy to handle.

BRIEF DESCRIPTION OF DRAWINGS

FIG. 1 is an overall perspective view of the ball-point pen viewed from its cap side;

FIG. 2 is an overall perspective view of the same pen viewed from its tail plug;

FIG. 3 is an overall perspective view of the ball-point pen with its cap removed;

FIG. 4 is an exploded perspective view of the ball-point pen;

FIG. 5 is a vertical sectional view of the ball-point pen with its pen point capped;

FIG. 6 is an enlarged view of an area VI in FIG. 5;

FIG. 7 is a vertical sectional view of the ball-point pen with its tail plug side capped;

FIG. 8 an enlarged view of an area VIII in FIG. 7;

FIG. 9 is a view for illustrating one of main components of the present invention;

FIG. 10 is a vertical sectional view of a refill;

FIG. 11 is an enlarged view of an area XI in FIG. 10;

FIG. 12 is a vertical sectional view of a tip in accordance with the present invention;

FIG. 13 is a vertical sectional view of a joist in accordance with the present invention;

FIG. 14 is a view sectioned by a plane containing a line XIV—XIV in FIG. 13 and taken from a direction of an arrow;

FIG. 15 is a side view of the same joint;

FIG. 16 is a view from a direction of an arrow XVI in FIG. 15;

FIG. 17 is a view sectioned by a plane containing a line XVII—XVII in FIG. 15 and taken from a direction of an arrow;

FIG. 18 is a vertical sectional view of a mouthpiece in accordance with the present invention;

FIG. 19 is a side view of a hollow barrel;

FIG. 20 is an enlarged vertical sectional view of a cap in accordance with the present invention;

FIGS. 21 and 22 show a variational example of a tail plug;

FIG. 21 is a vertical sectional view;

FIG. 22 is a perspective view of FIG. 21;

FIG. 23 is an enlarged view of a pen tip part;

FIG. 24 is a view of the part shown in FIG. 23 with its tip up;

FIG. 25 is a side view of a spring;

FIG. 26 is an enlarged backside view of the spring;

FIG. 27 is a view showing a partially variational example of the spring in which a front part of a spring other than its straight part is formed in a conical helix;

FIG. 28 is an enlarged view of a pen tip part;

FIG. 29 is a view showing the part shown in FIG. 28 with its tip up;

FIG. 30 is an enlarged view of a pen tip part;

FIG. 31 is a view showing the part shown in FIG. 30 with its tip up;

FIG. 32 is an enlarged view of a pen tip part in which use is made of a spring which is modified from the spring used in the second embodiment in such a way that the rear end of the spring is bent in parallel with the diameter of the coil part;

FIG. 33 a view showing the part shown in FIG. 32 with its tip up;

FIG. 34 is an enlarged backside view of the coil part of the spring applied to the embodiment;

FIG. 35 is a view showing a partially variational example of the spring shown in FIGS. 32 to 34 and shows a configuration in which, in place of a straight part of the spring, a separate pushing rod member is attached to the front end of a coil part of a spring;

FIG. 36 is a view showing a wholly variated spring and shows a configuration in which the front straight part of the spring is formed parallel to a central axis of a coil part and the coil part is conically tapered or reduced in diameter toward the front end thereof;

FIG. 37 is another wholly variated spring and shows a configuration in which the front straight part shown in FIG. 36 is slanted toward the central axis of the coil part;

BEST MODE FOR CARRING OUT THE INVENTION

A ball-point pen 1 in accordance with the present invention will be described in detail based on an embodiment illustrated.

(Ball-point pen 1)

Figure 1:
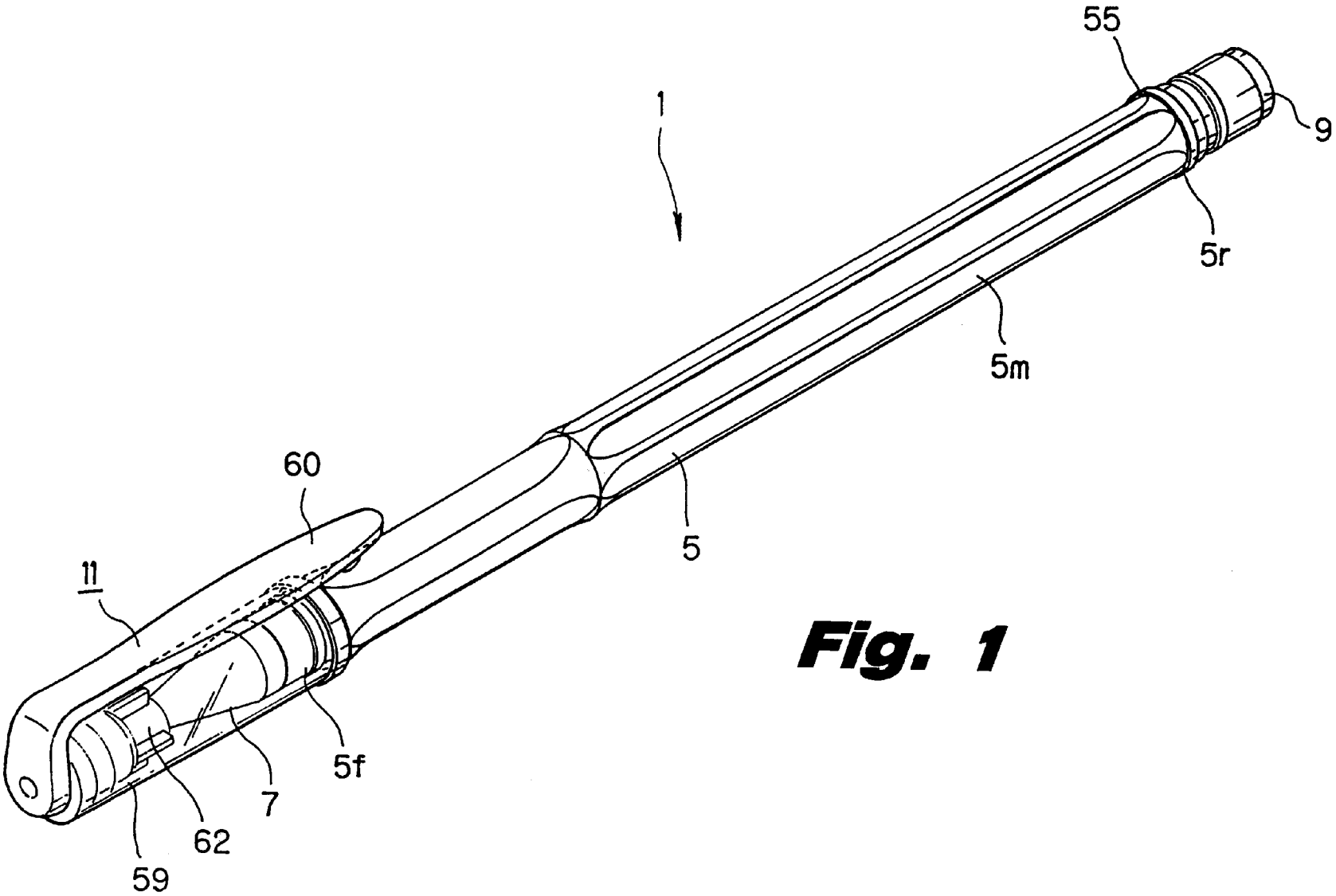
FIGS. 1 through 21 show a first embodiment of a ball-point pen in accordance with the present invention.
Figure 2:
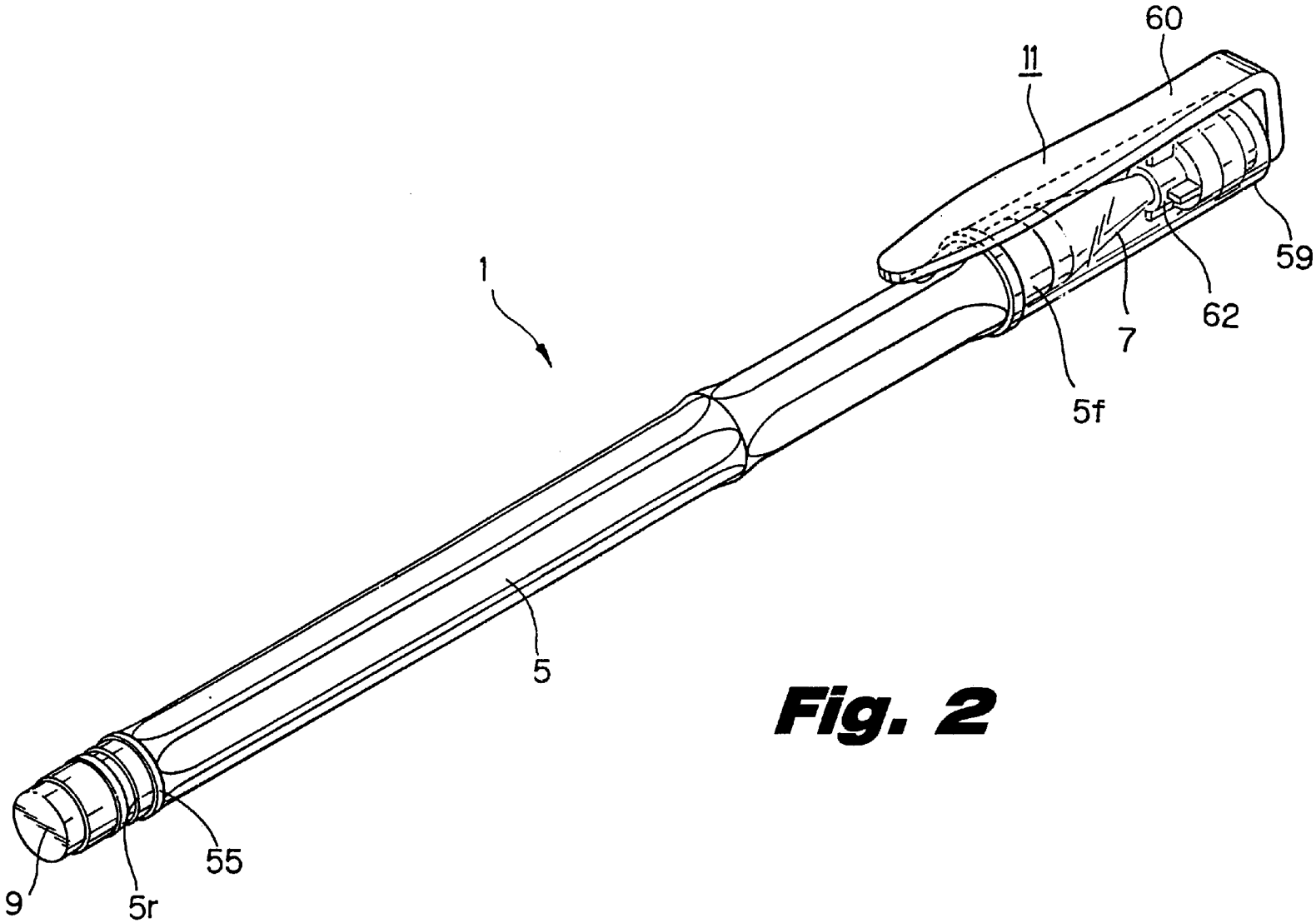
Figure 3:
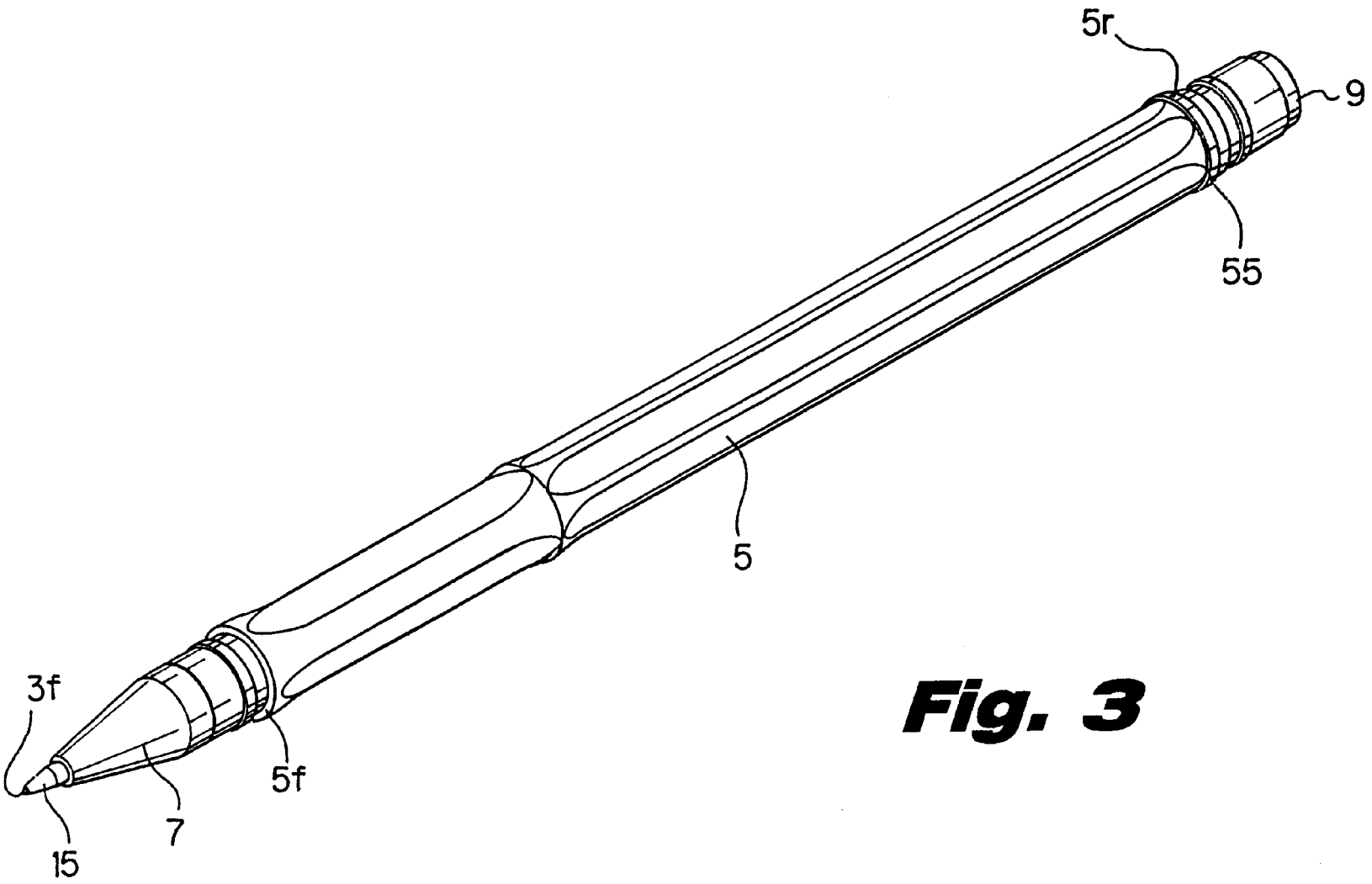
Figure 4:
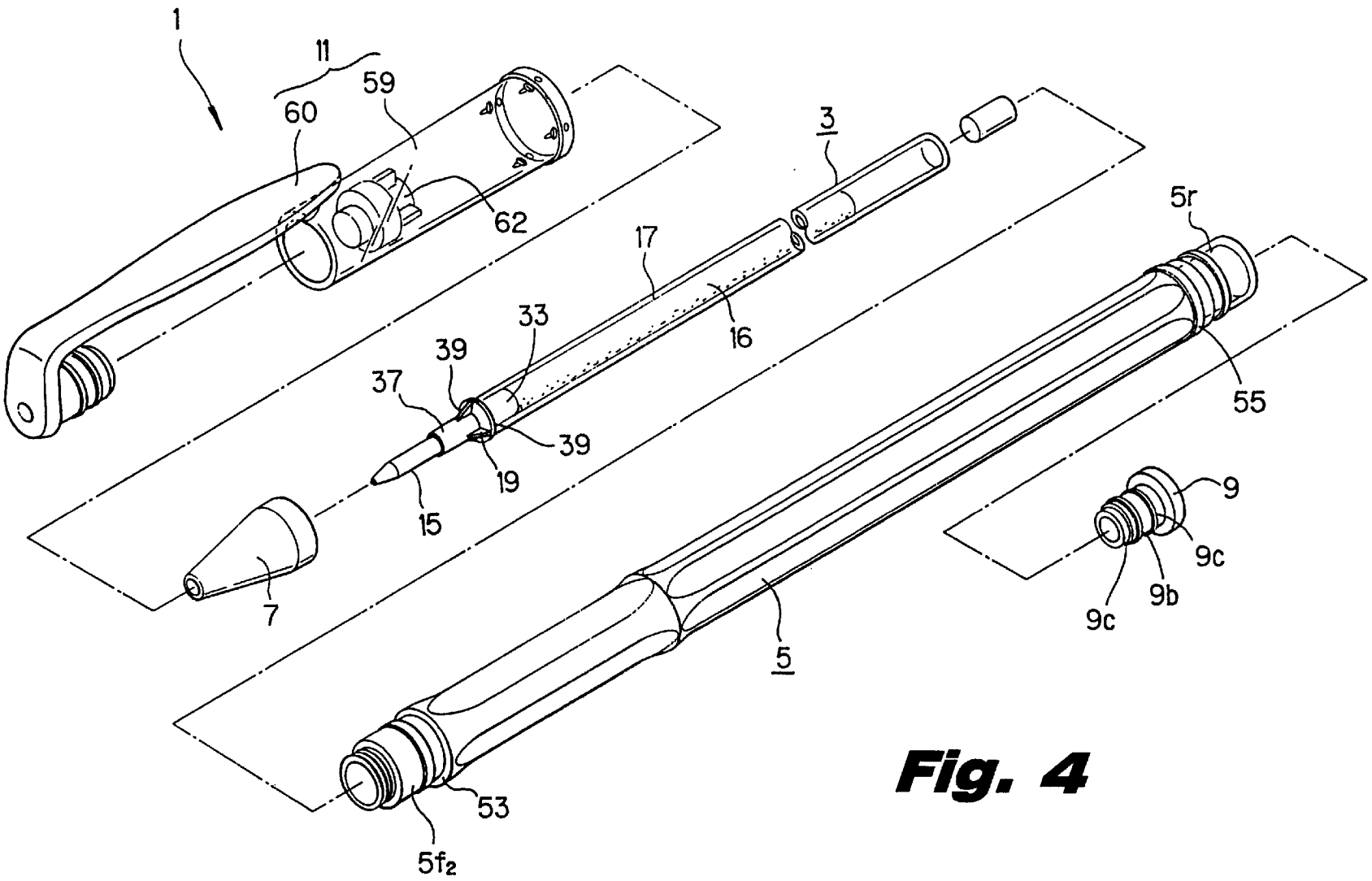
Figure 5:
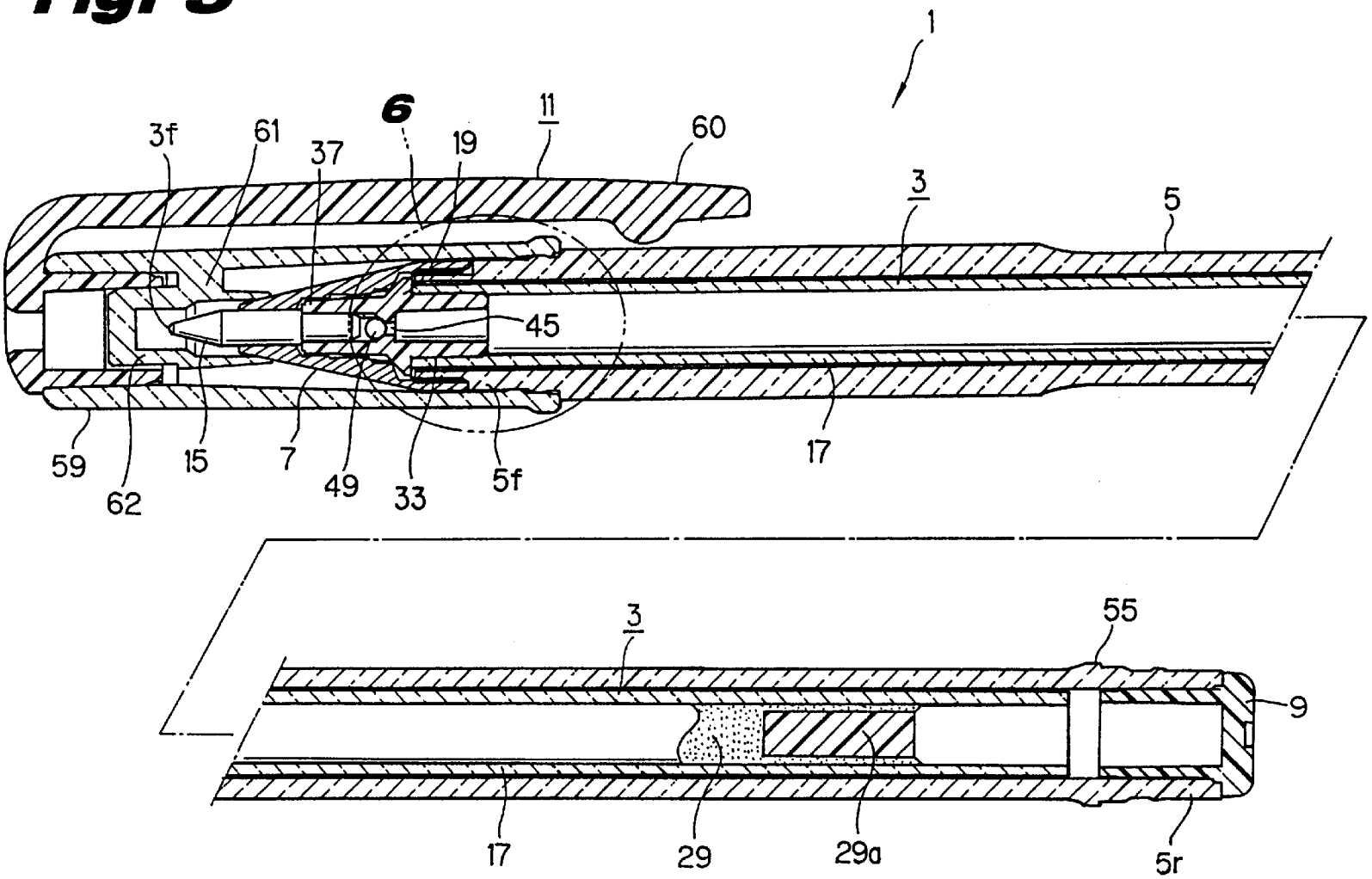
Figure 7:
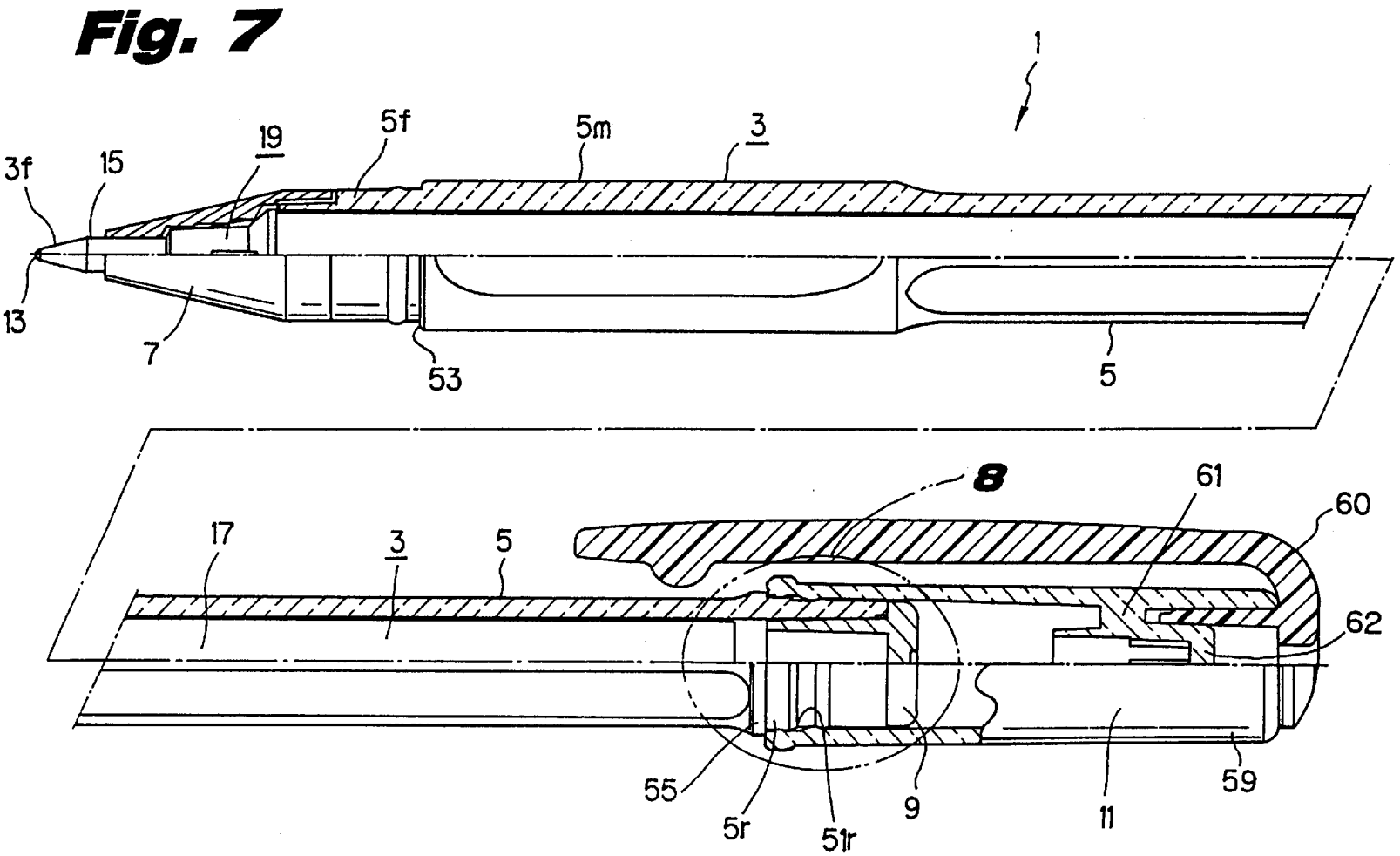

As is apparent from FIGS. 4, 5 and 7 etc., a ball-point pen 1 comprises: a ball-point pen refill 3; a hollow barrel 5 incorporating the ball-point pen refill 3; a hollow, conical-shaped mouthpiece 7 disposed at a front end of the hollow barrel 5 for securely supporting the ball-point pen refill 3; a tail plug 9 disposed on the other side of the hollow barrel 5; and a cap 11 which may be fitted on any of ends 5*f* and 5*r* having the mouthpiece 7 and the tail plug 9 in the hollow barrel 5.

(Ball-point pen refill 3)

The ball-point pen refill 3, as shown in FIGS. 3, 4, 5, 10, 11 and 12, is composed of: a tip 15 having a front end 3*f* which rotatably holds a writing micro-ball 13 and is projected from the mouthpiece 7; an ink storing pipe 17 made of a transparent resin and filled with unillustrated ink for supplying ink 16 to the tip 15; and a joint 19 connecting the ink storing pipe 17 with the tip 15 for supplying ink from the ink storing pipe 17 to the tip 15.

(Tip 15)

Figure 11:
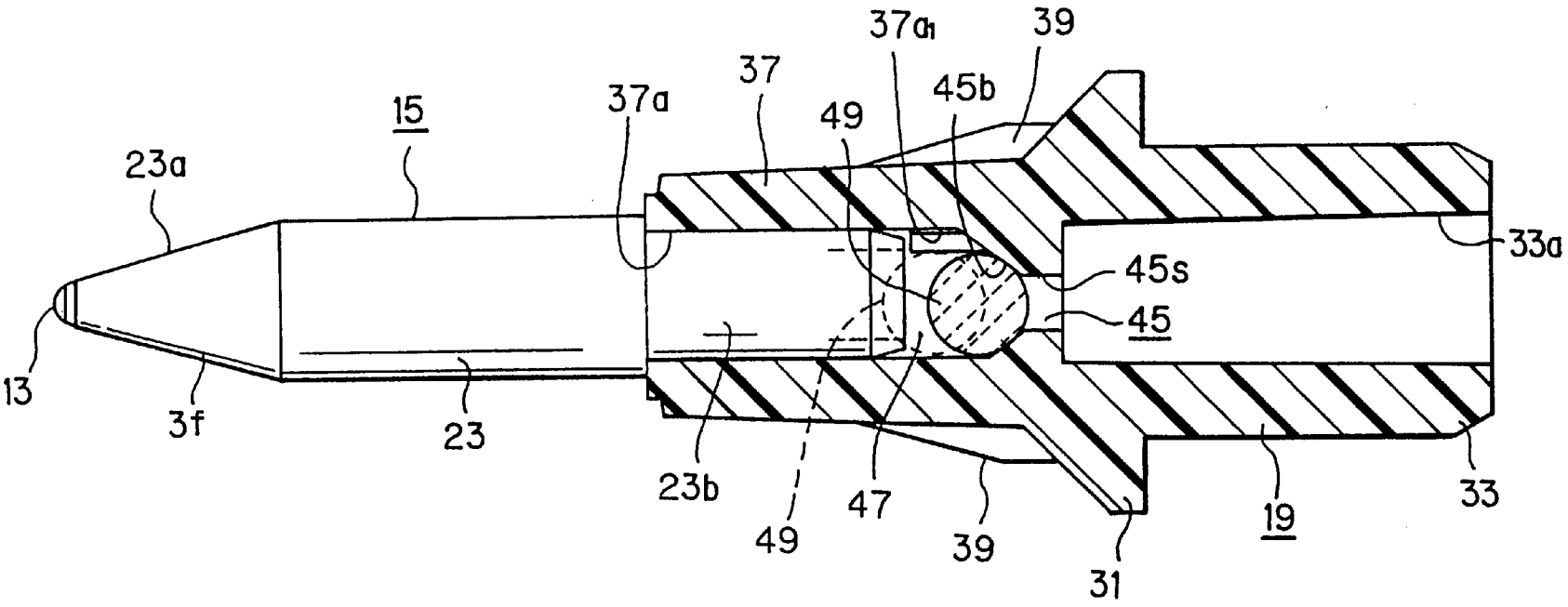
Figure 12:
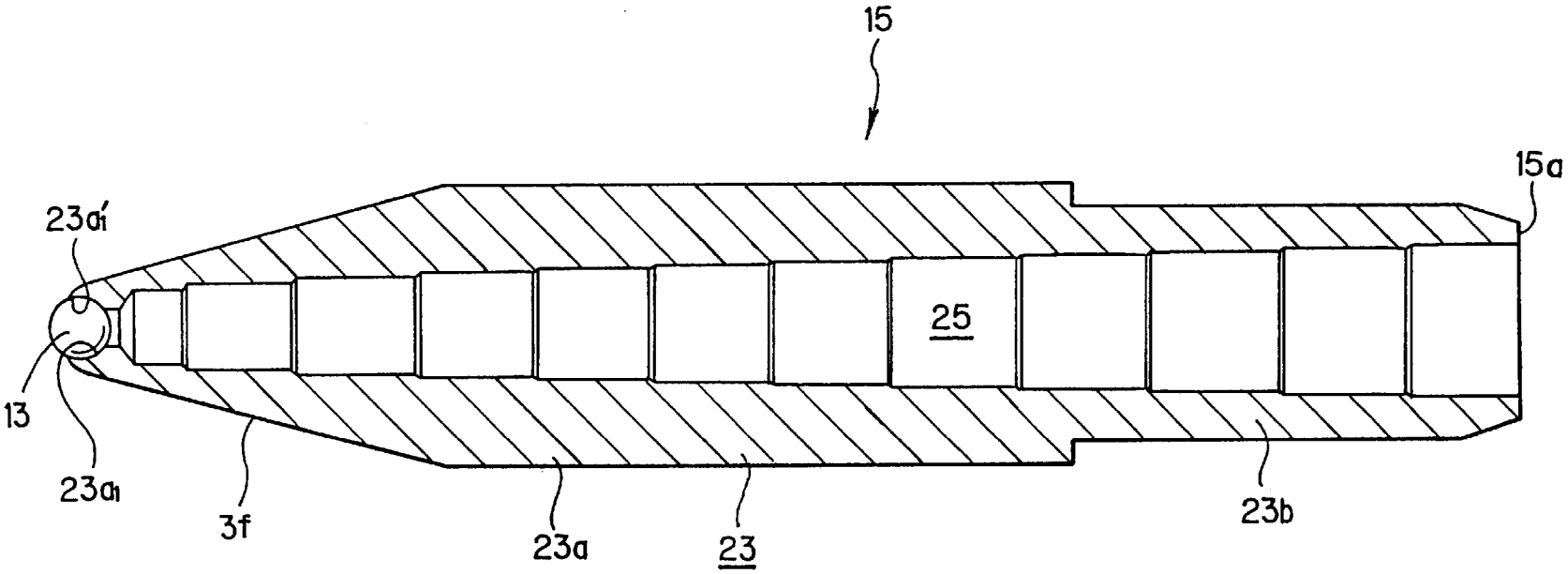

The tip 15, a shown in FIGS. 11 and 12, is composed of: the writing micro-ball 13 as a perfect sphere cemented carbide ball made of tungsten carbide; and a hollow holder 23 made of stainless steel. The hollow holder 23 comprises a bullet-shaped major part 23*a* and a tubular part 23*b* which is extended from the rear of the major part 23*a* and is smaller in diameter than the major part 23*a* for being securely fitted into an aftermentioned tip-side bore 37*a* of the joint 19 with a proper fixing means. The major part 23*a* has, at its front edge, a ball socket seat $\mathbf{23}a_1$ which is press-formed and rotatably holding the writing micro-ball 13, and has a conically stepped bore 25 thereinside having a rear opening.

(Ink storing pipe 17)

Figure 10:
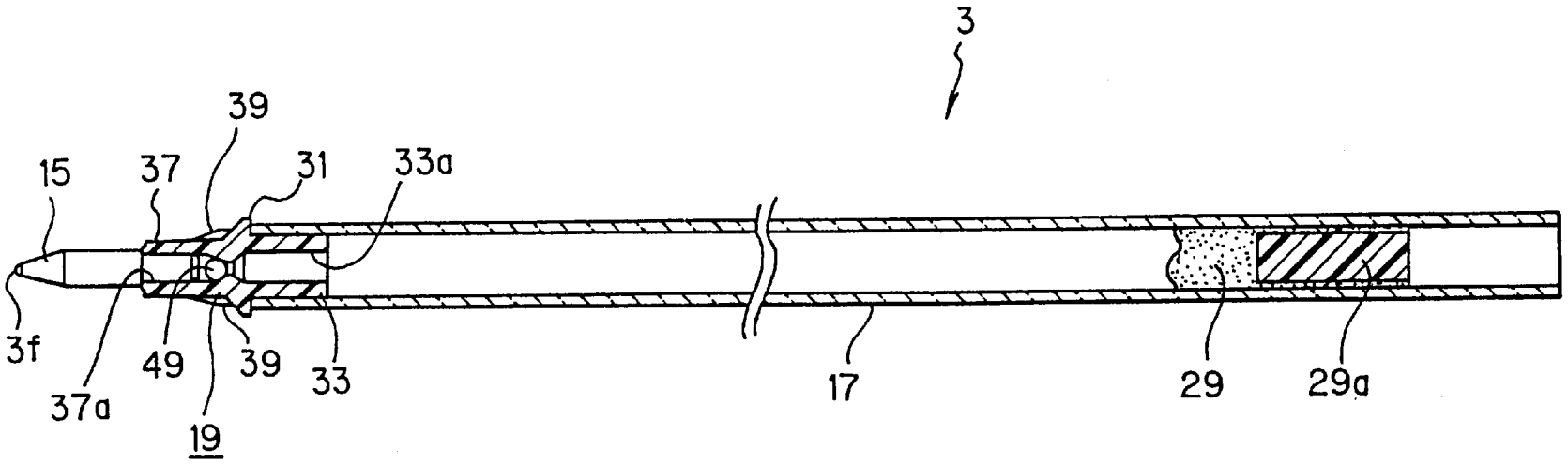

The ink storing pipe 17 is filled with thixotropic ink, as shown in FIGS. 4, 5 and 10. The thixotropic ink is one which presents a high viscosity in a static state where the ball-point pen is unused but lowers its viscosity in a dynamic state where the ball-point pen is used with the writing micro-ball 13 rotating on the surface of paper.

In order to prevent the ink in the ink storing pipe 17 from evaporating, a greasy transparent follower 29 is placed on the rear end face of the ink to abut the ink surface in such a manner as to move in the ink storing pipe 17 following the ink. In order to make the follower 29 follow the ink stably as well as to make the follower 29 hard to come out from the ink storing pipe 17 when the ball-point pen 1 fell, a follower rod 29*a* having an equal specific gravity to that of the follower 29 is buried in the follower 29. This follower rod 29*a* is formed in a rod shape of a pipe member having a smaller diameter than the inside diameter of the ink storing pipe 17. Here, a silicone rubber may substitute for the follower 29.

(Joint 19)

The joint 19 is made of a resiliently deformable synthetic resin of the same color with that of the ink stored in the ink storing pipe 17. As shown in FIGS. 4, 10, 11, 13, 15 and 16, the joint 19 is formed of a hollow sleeve having a flange 31 in the middle portion of the length. The rear half of the joint behind the flange 31 is formed with an ink-storing-pipe-side bore 33*a* for allowing ink to pass from the ink storing pipe 17 and constitutes a squeezing pipe portion 33 to be squeezed into the front part of the ink storing pipe 17. The other portion of the joint or the front half in front of the flange 31 is formed with a tip-side bore 37*a* for delivering the ink flowing from the ink storing pipe 17 to the tip and constitutes a fitting pipe portion 37 fitted to the mouthpiece 7. Formed between the fitting pipe portion 37 and the flange 31 are a plurality of slant ribs 39,39 . . . (a configuration with four slant ribs 39 arranged equidistantly is shown in this embodiment.) At least one of aftermentioned stepped portions 57*a*,57*a* . . . is engaged with the slant ribs 39,39 . . . in a biting manner.

Communicated between the two bores, that is, the tip-side bore 37*a* and the ink-storing-pipe-side bore 33*a* is a funnel-shaped communicating hole 45 which is composed of a large-diameter frustum portion 45*b* connected to the tip-side bore 37*a* and a small-diameter portion 45*s* connected to the ink-storing-pipe-side bore 33*a* and which is disposed eccentrically to the aforementioned bores 37*a* and 33*a*. A large ball 49 having a greater diameter than a bore ls of the small-diameter portion 45*s* is disposed idly in at least a part of a space 47 defined by the large-diameter portion 45*b* and a rear edge 15*a* of the tip 15 when the tip 15 is fitted into the tip-side bore 37*a* (in other words, a space combined of the space of the tip-side bore 37*a* on the side of the tail plug 9 and the inner space of the large-diameter portion 45*b*).

Figure 13:
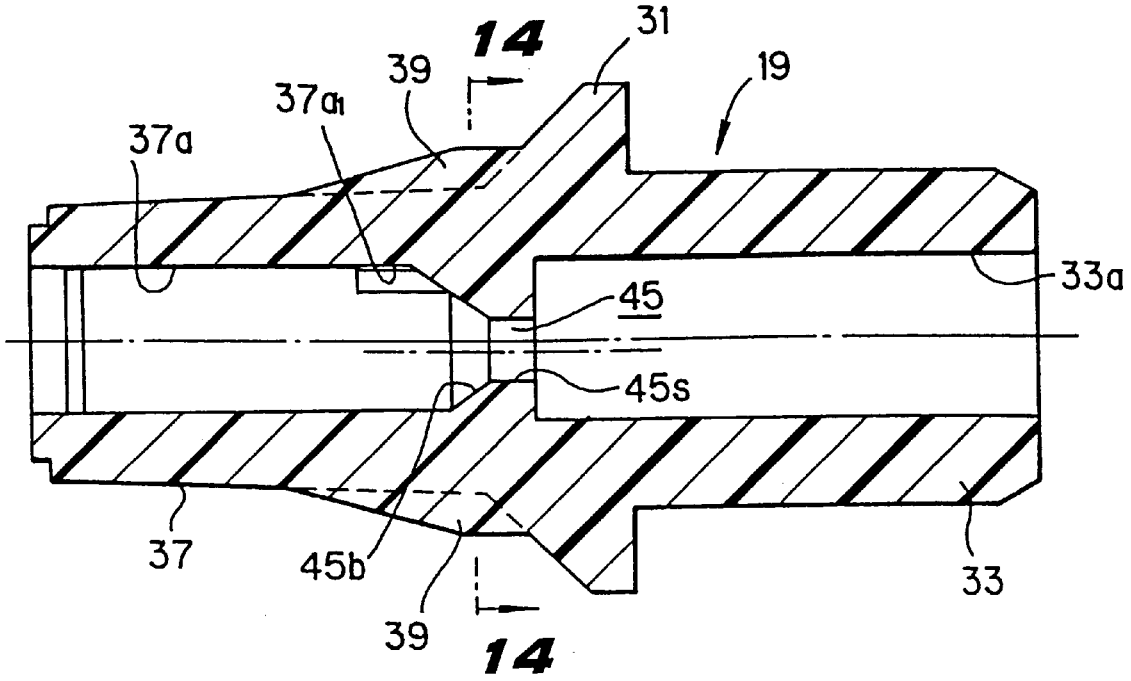
Figure 14:
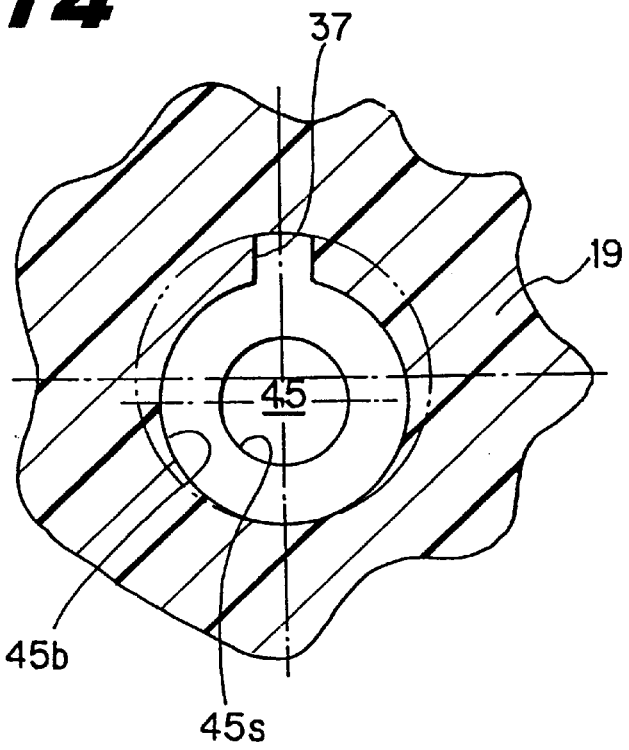
Figure 15:
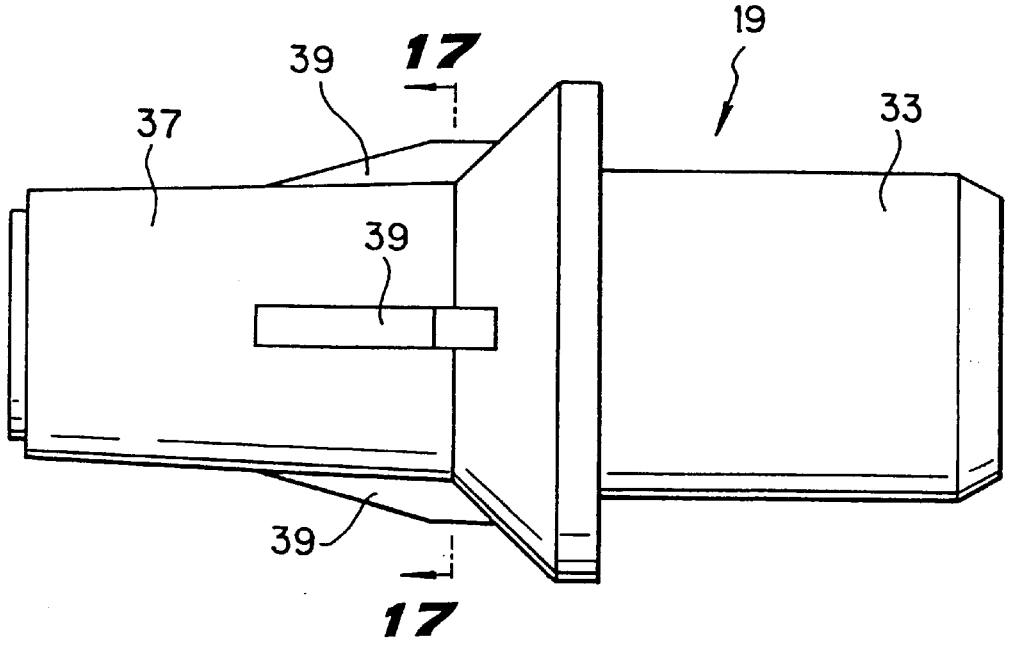
Figure 16:
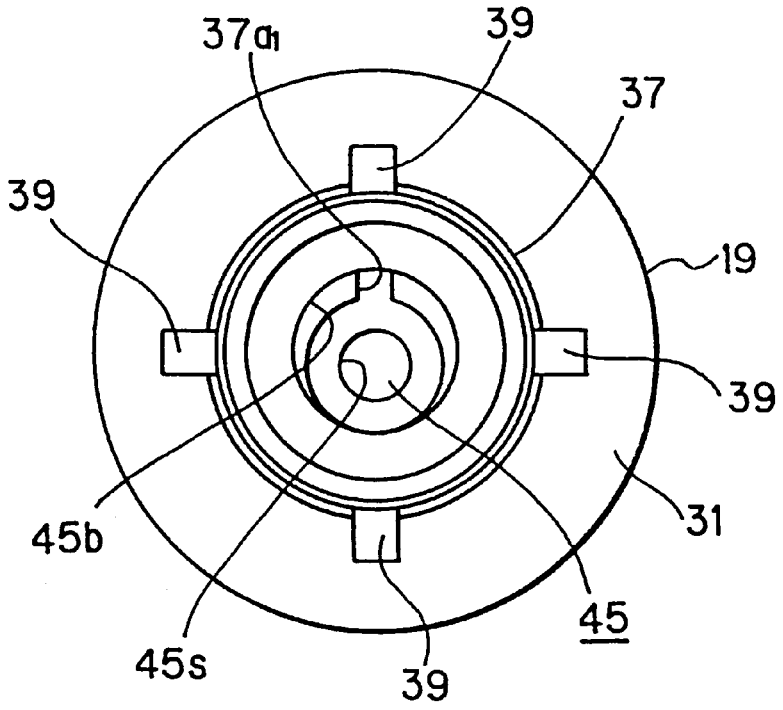
Figure 17:
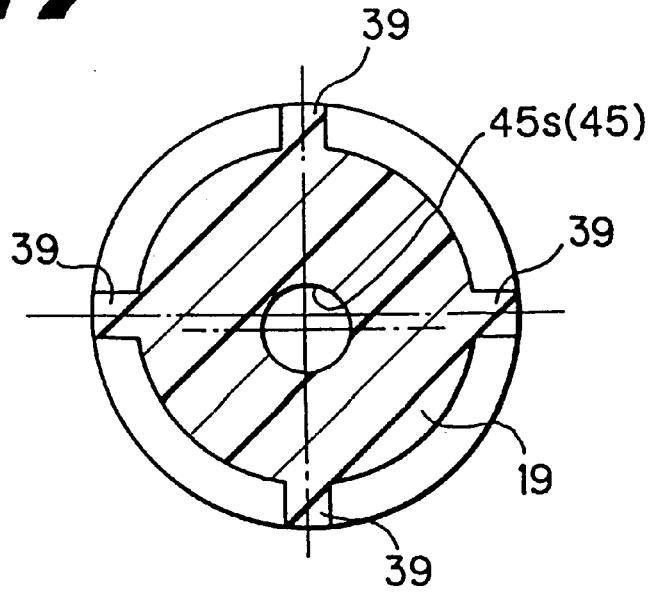

As shown in FIGS. 11, 13 and 14, a groove 37$a_1$ extending from the large-diameter portion 45*b* toward the tip 15 is formed on the inner surface of the tip-side bore 37*a*.

The joint 19 shown in this embodiment is formed separately from the hollow barrel 5 detailed next but these two elements may be formed integrally.

(Hollow barrel 5)

The hollow barrel 5 is a hollow rod-like member of a transparent resin with both ends open and serves as a grip when writing is done. As is understood from FIGS. 1 through 9 and FIG. 19, the hollow barrel 5 comprises; a major barrel portion 5*m* in which most part of the ink storing pipe 17 of the ball-point pen refill 3 is accommodated; a mouthpiece-side end 5*f* consisting of a thread portion 5$f_1$ on which the mouthpiece 7 is screwed and a joining portion 5$f_2$ located between the thread portion 5$f_1$ and the major barrel portion 5*m*; and a tail-plug-side end 5*r* to which the tail plug 9 is attached.

Figure 6:
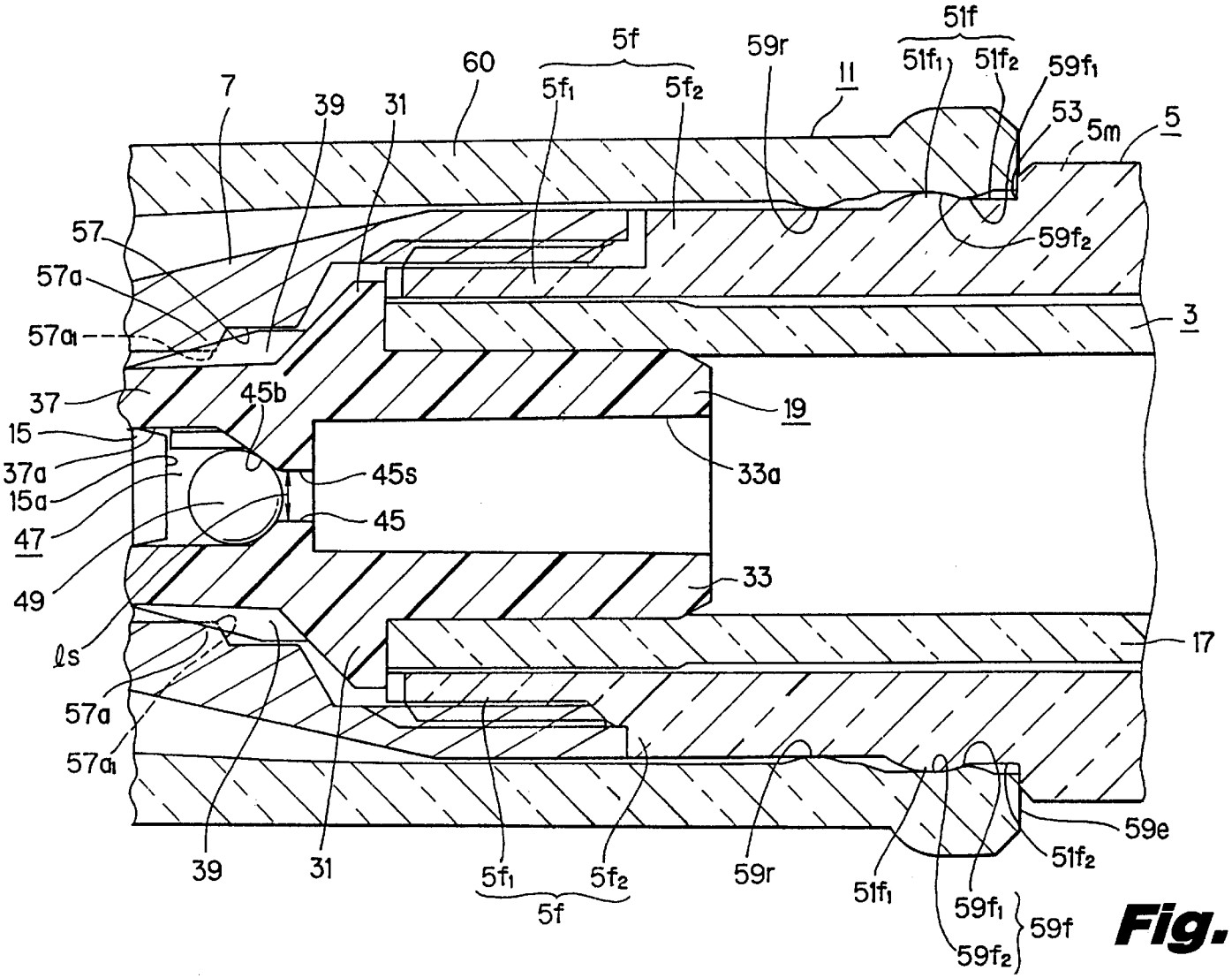

As apparent from FIG. 6, the joining portion 5$f_2$ is formed with a receiving-side engaging portion 51*f* which mates with an engaging portion 59*f*, one of two aftermentioned engaging portions 59*f* and 59*r* which are positioned apart in the axial direction on the cap 11. The tail-plug-side end 5*r* is formed with a receiving-side engaging portion 51*r* which mates with the engaging portion 59*r*, the other one of the aforementioned engaging portions 59*f* and 59*r*, as understood from FIG. 8.

The receiving-side engaging portion 51*f* is provided with a beading projection 51$f_1$ on the peripheral side of the joining portion 5$f_2$ on the side near to the major barrel portion 5*m* so as to create a projection-recess structure. Here, a recessed portion located between the beading projection 51$f_1$ as the projected portion and the major barrel portion 5*m* will be designated at 51$f_2$. There is a difference in diameter between the major barrel portion 5*m* and the joining portion 5$f_2$, forming a stepped portion 53. This stepped portion 53 is adapted to bear an aftermentioned end 59*e* of the cap 11.

On the other hand, the other receiving-side engaging portion 51*r* is provided with a beading projection 51*r* which is somewhat smaller than the beading projection 51$f_1$ of the receiving-side engaging portion 51*f* and located on the peripheral side of the tail-plug-side end 5*r* near to the center with respect to the lengthwise direction so as to create a projection-recess structure. Here, a recessed portion in the receiving-side engaging portion 51*r* will be designated at 51$r_2$. A flange 55 is formed in a site displaced slightly toward the pen-tip side from the recessed portion 51$r_2$. This flange 55 is also adapted to bear the aftermentioned end 59*e* of the cap 11.

Figure 8:
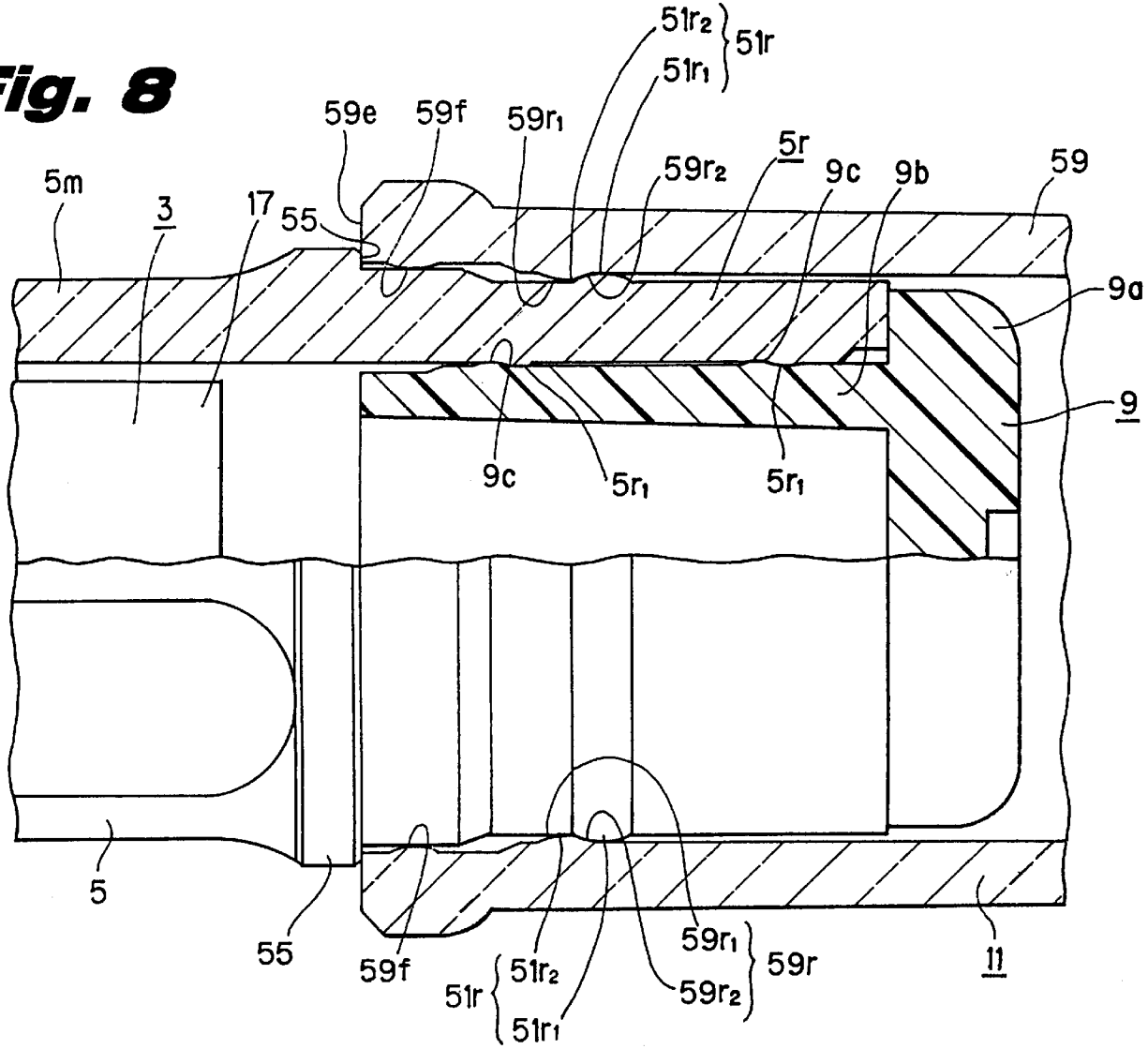
Figure 9:
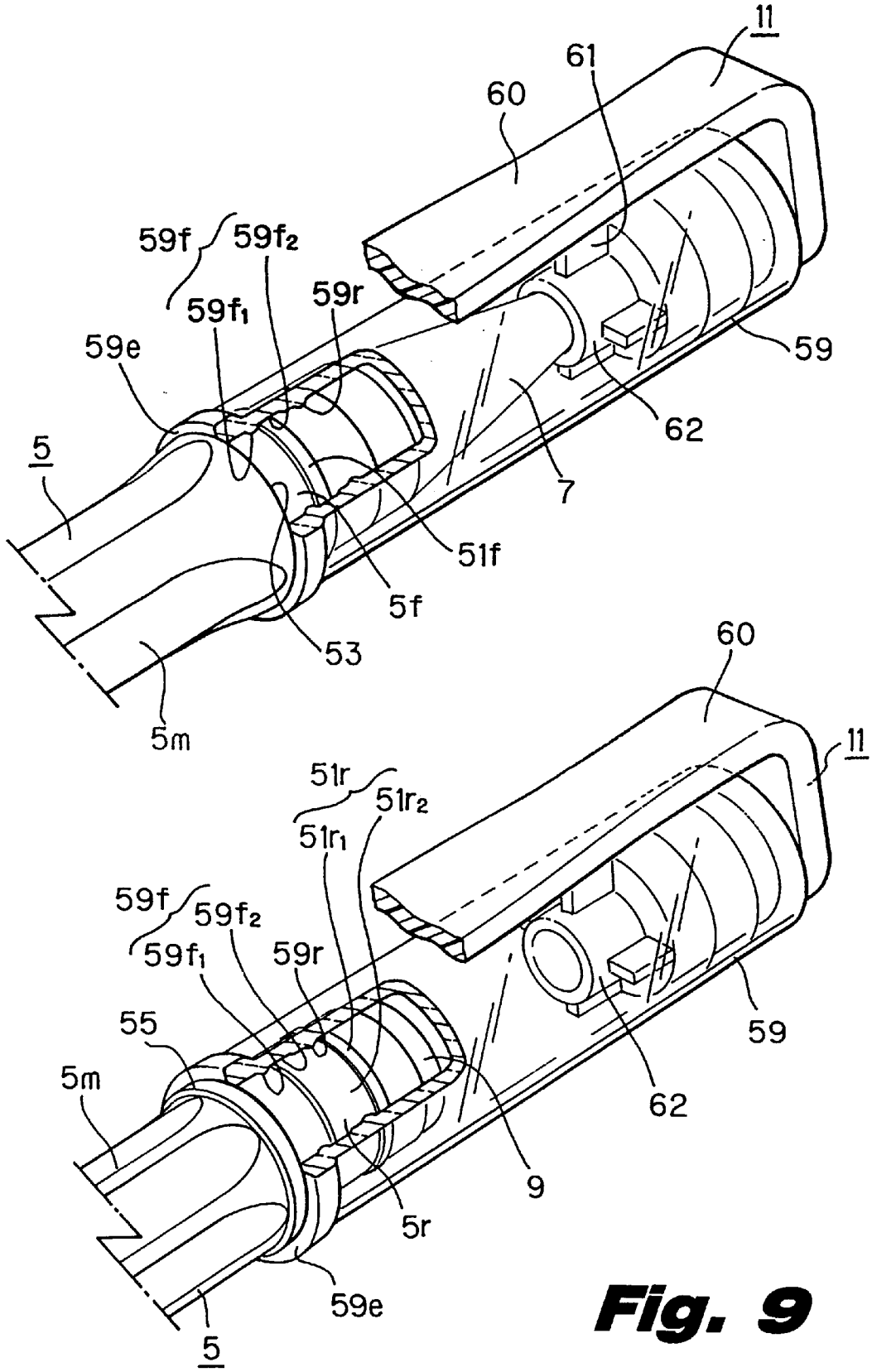

As seen in FIG. 8, the inner peripheral side of the tail-plug-side end 5*r* is formed with flattened beading projections 5$r_1$, 5$r_1$ which engage flattened beading projections 9*c*, 9*c* provided on the outside peripheral surface of an aftermentioned cylindrical portion 9*b* in the plug 9. It should be noted that these flattened beading projections 5$r_1$, 5$r_1$ may be omitted.

(Mouthpiece 7)

Figure 18:
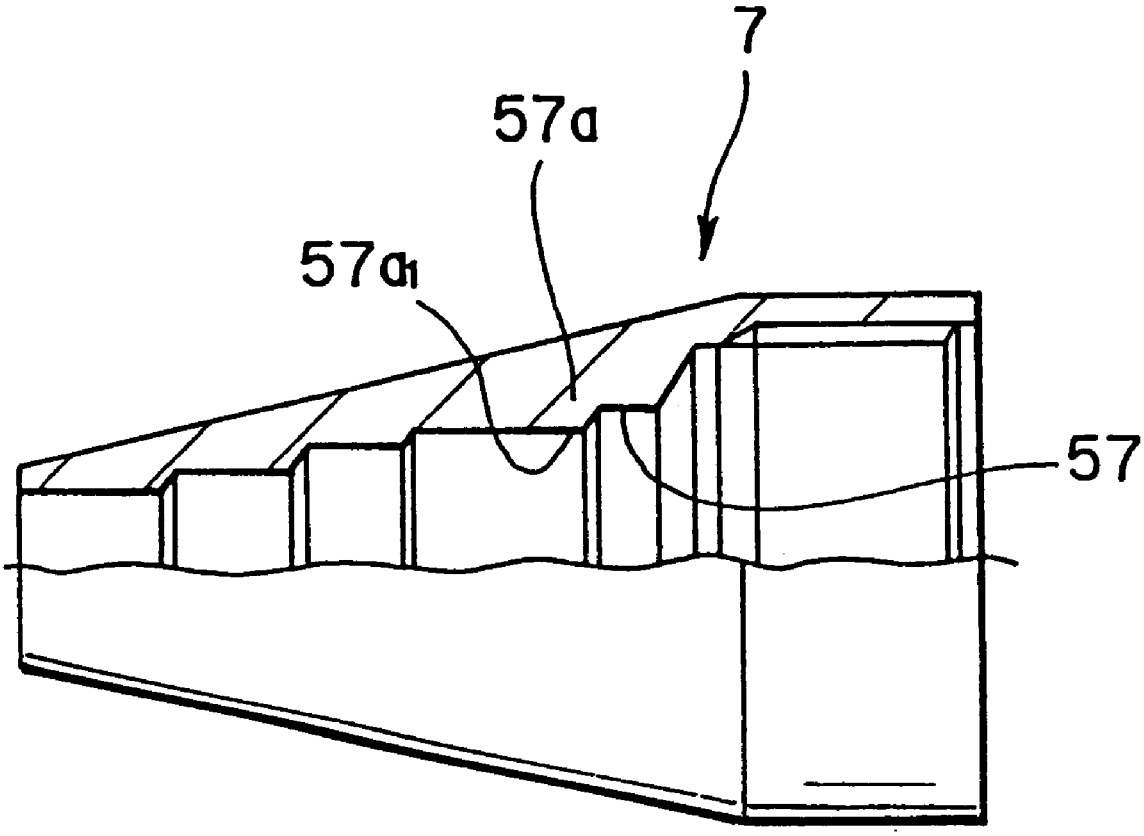
Figure 19:
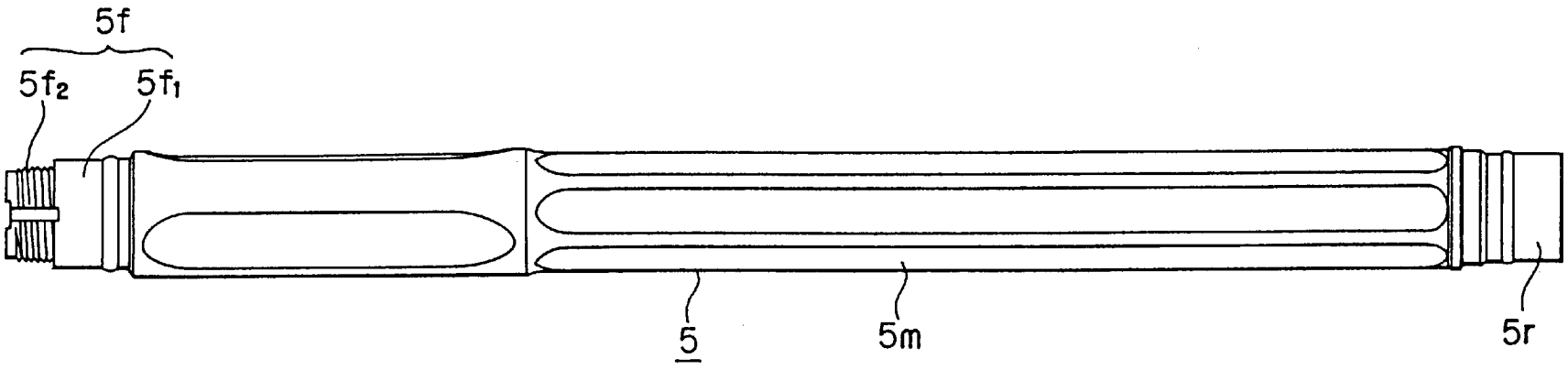
Figure 20:
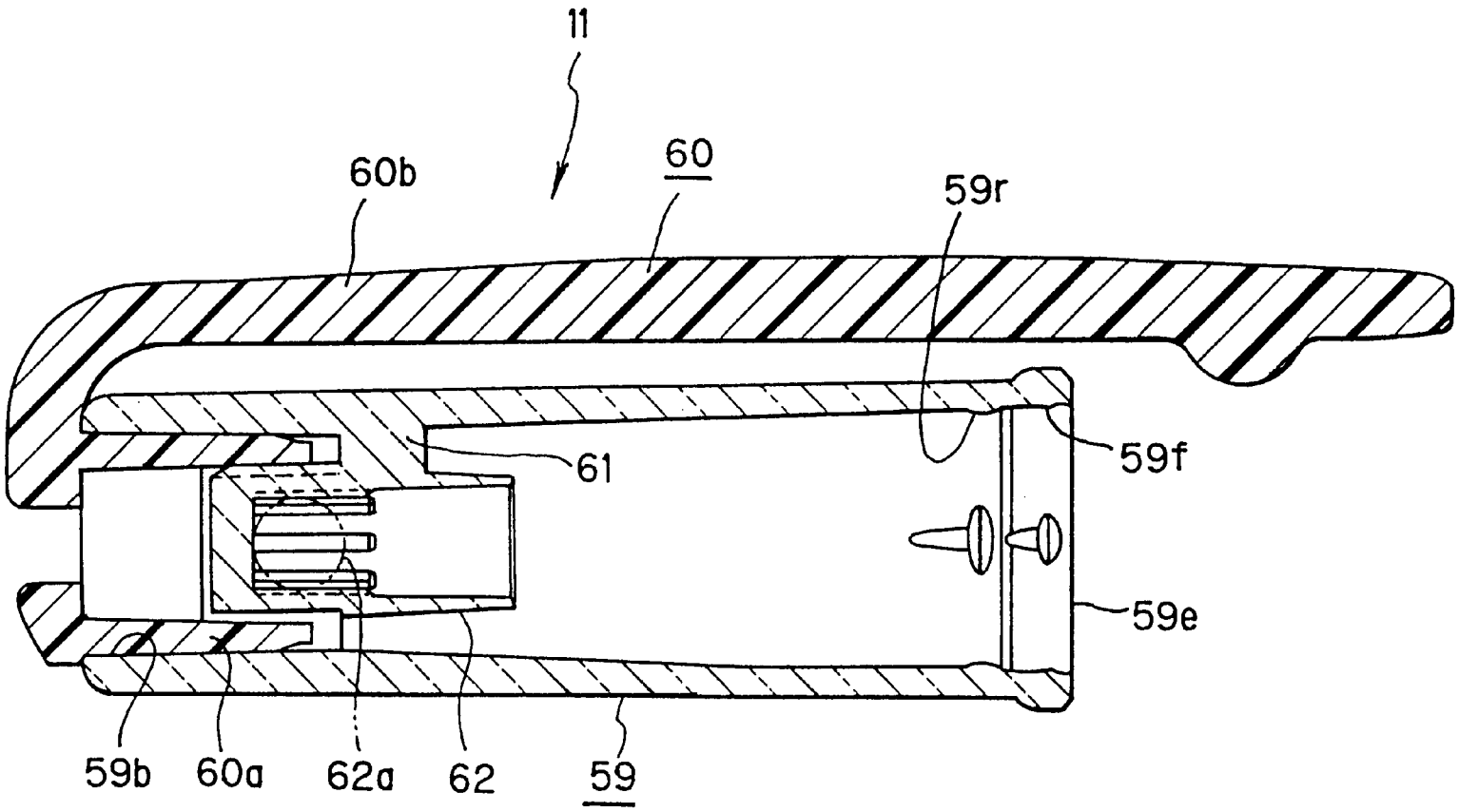

The mouthpiece 7 has a conically stepped bore 57 drilled thereinside as shown in FIG. 18. At least one of steps 57*a*, 57*a*, . . . in the stepped bore 57 is arranged so that a ridge part 57$a_1$ of the step 57*a* may engage the slant ribs 39, 39, . . . of the joint 19 in a biting manner.

(Tail plug 9)

As shown in FIG. 8, the tail plug 9 is formed of a cylinder having an opening end on one side. The closed side of the cylinder is formed with an annular flange 9*a* protruding outward in all directions. Flattened beading projections 9*c*, 9*c* are formed apart in the axial direction on the outside peripheral surface of a cylindrical portion 9*b*. When the cylindrical portion 9*b* is fitted into the tail-plug-side end 5*r* of the hollow barrel 5, the flange 9*b* prevents the tail plug from entering any further. The beading projections 9*c*, 9*c* prevent the tail plug 9 from slipping out from the hollow barrel 5.

Figure 21:
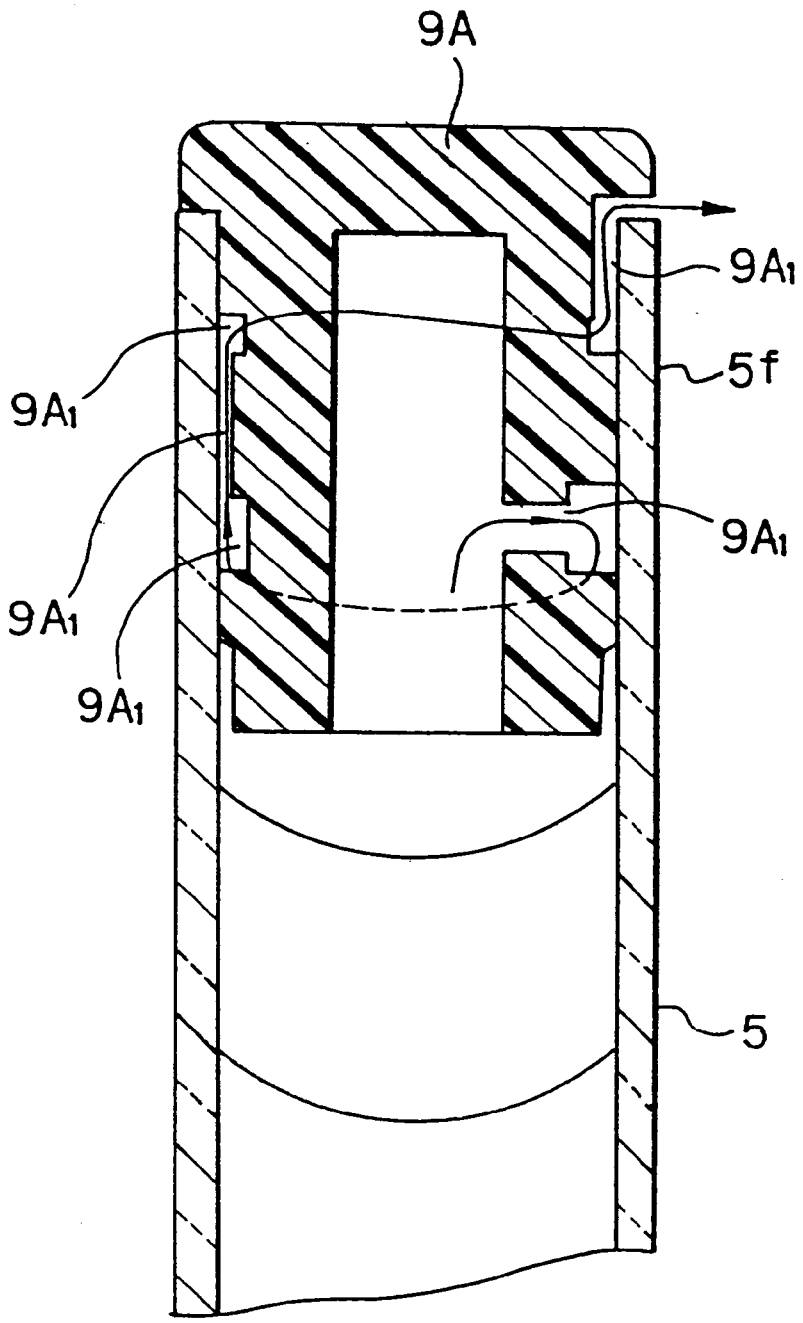
Figure 22:
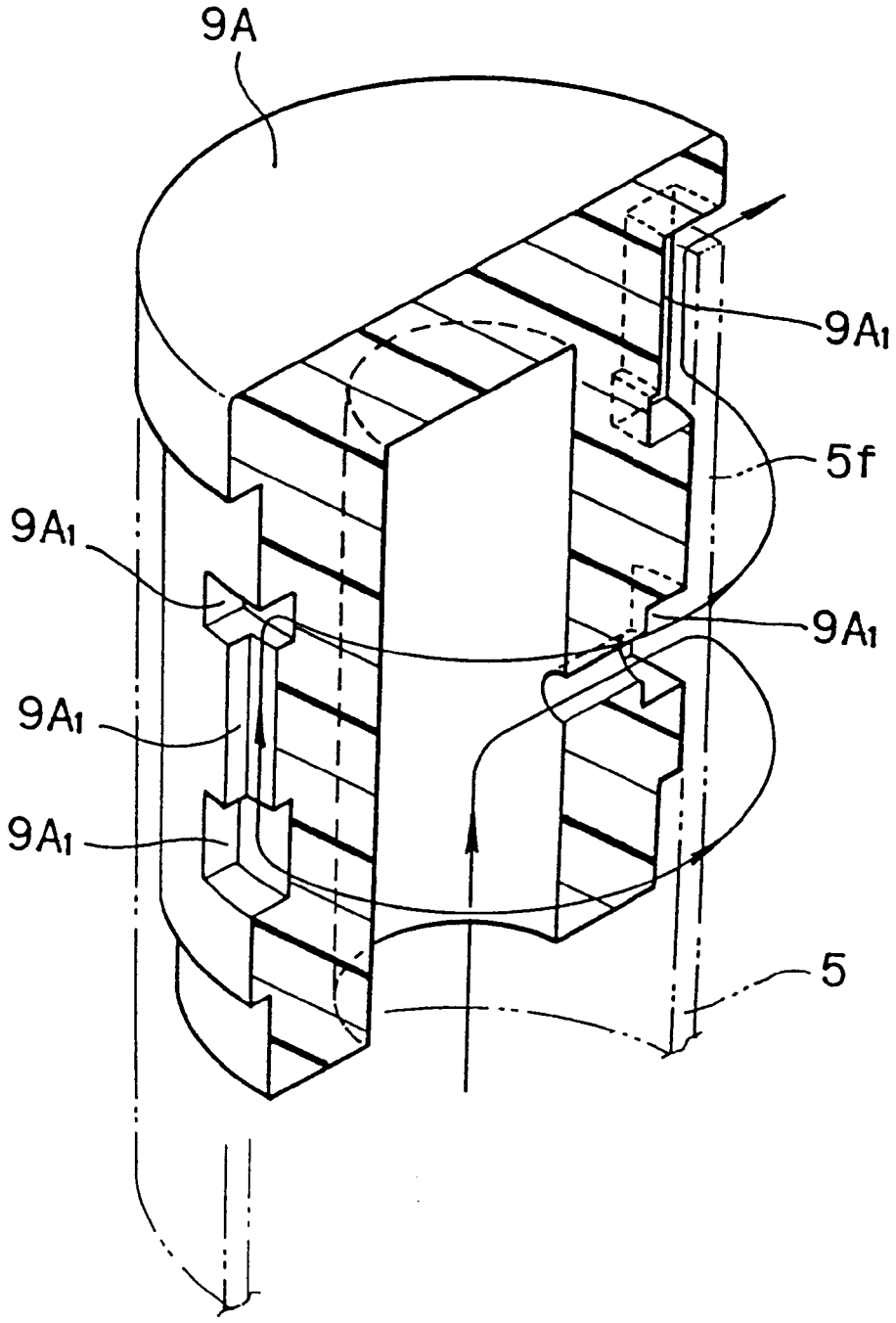

As in a tail plug 9A shown in FIGS. 21 and 22, when a plurality of air passages 9$A_1$, 9$A_1$, . . . are complexly formed like a maze in the tail plug along the circumferential direction and the axial direction, it is possible to prevent ink from evaporating and the follower from drying, more effectively.

(Cap 11)

The cap 11 is a molding made of a transparent resin having excellent resiliency. As shown in FIGS. 1, 3, 5 through 9, and 20, the cap comprises: a cap body 59 which covers the mouthpiece-side end 5*f* and the tail-plug-side end 5*r* of the hollow barrel 5 having the tail plug 9 and mouthpiece 7 when the ball-point pen 1 is unused and when the pen is used, respectively; and a clip 60 integrally formed with the cap body 59.

The cap body 59 has two engaging portions 59*f* and 59*r* formed apart in the axial direction on the inner peripheral surface near the opening side. As apparent from FIG. 6, the engaging portion 59*f* that is nearer to the opening will mate the receiving-side engaging portion 51*f* provided on the mouthpiece-side end 5*f* of the hollow barrel 5 while the other engaging portion 59*r* that is positioned more inside than the engaging portion 59*f* will mate the other receiving-side engaging portion 51*r* provided on the tail-plug-side end 5*r* of the same hollow barrel.

The engaging portion 59*f* is created with a beading projection 59$f_1$ which is flatter than the beading projection 51$f_1$ of the hollow barrel 5 and provided near the end 59*e* on the opened inner peripheral side of the cap body 59 so as to form a projection-recess structure. Here, a recessed portion relative to the beading projection 59$f_1$ as the projected portion will be designated at 59$f_2$.

The other engaging portion 59*r* is, as understood from FIG. 8, is formed with a beading projection 59$r_1$ that is approximately as large as or somewhat larger than the beading projection 59$f_1$ so as to create a projection-recess structure on the inner peripheral surface of the cap body 59. Here, a recessed portion for the beading projection 59$r_1$ will be designated at 59$r_2$.

An inner cap 62 having a sealing cork 62*a* thereinside for sealing extra ink on the pen point when the pen point is capped is integrally formed in the central part of the cap body 59 and supported by supporting arms 61 provided on the inner wall of the cap body 59. Here, the inner cap 62 is formed with a vent 63 for allowing an infant to breathe even in case the infant accidentally swallowed the cap 59.

Formed on the opposite side to the cap opening in the cap body 59 is a clip attaching hole 59*b* for attaching the clip 60 to the cap body 59.

The clip 60 comprises: an attachment sleeve 60*a* which has a through-hole therein and serves as a squeezed portion into the clip attaching hole 59*b*; and a clipping portion 60*b*.

When the thus constructed cap 11 is fitted onto the mouthpiece-side end 5*f* of the hollow barrel 5 having the mouthpiece 7, the beading projection $59f_1$ of the engaging portion 59*f* of the cap 11 is fitted in the recessed portion $51f_2$ of the receiving-side engaging portion 51*f* formed on the mouthpiece-side end 5*f* of the hollow barrel 5, as shown in FIG. 6, and at the same time, the beading projection $51f_1$ of the receiving-side engaging portion 51*f* is fitted in the recessed portion $59f_2$, whereby the engaging portion 59*f* of the cap 11 engages the receiving-side engaging portion 51*f* of the hollow barrel 5 and the cap 11 can be prevented from falling off from the mouthpiece-side end 5*f*. In this case, in order to prevent the cap 11 from engaging the mouthpiece-side end 5*f* more deeply than needed, the end 59*e* of the cap 11 abuts the stepped portion 53 of the hollow barrel 5 as set forth above.

On the other hand, when the cap 11 is fitted onto the tail-plug-side end 5*r* of the hollow barrel 5 having the tail plug 9, the beading projection $59r_1$ of the other engaging portion 59*r* of the cap 11 is fitted in the recessed portion $51r_2$ of the receiving-side engaging portion 51*r* formed on the tail-plug-side end 5*r* of the hollow barrel 5, as shown in FIG. 8, and at the same time, the beading projection $51r_1$ of the receiving-side engaging portion 51*r* is fitted in the recessed portion $59r_2$, whereby the engaging portion 59*r* of the cap 11 engages the tail-plug-side end 5*r* of the hollow barrel 5 and the cap 11 can be prevented from falling off from the tailplug-side end 5*r*.

In this case, in order to prevent the cap 11 from engaging the tail-plug-side end 5*r* more deeply than needed, the end 59*e* of the cap 11 abuts the flange 55 of the hollow barrel 5 as set forth above.

(Operation and effects)

1) The ball-point pen 1 thus constructed comprises a ball-point pen refill 3; a hollow barrel 5 incorporating the ball-point pen refill 3; a hollow conical-shaped mouthpiece 7 disposed at a front end of the hollow barrel 5 for fixedly supporting the ball-point pen refill 3 relative to the hollow barrel 5; a tail plug 9 disposed at the opposite end of the hollow barrel 5 to the mouthpiece 7; and a cap 11 which is to be fitted onto each end 5*f*, 5*r* of the hollow barrel 5 having the tail plug 9 and the mouthpiece 7. The ball-point pen refill 3 comprises: a tip 15 rotatably holding a writing micro-ball 13 fitted by press-forming at a front end thereof and projecting the front end from the mouthpiece 7; an ink storing pipe 17 filled with ink for supplying ink to the tip 15; and a joint 19 connecting the ink storing pipe 17 with the tip 15 for delivering ink from the ink storing pipe 17 to the tip 15. The joint 19 is formed with a tip-side bore 37*a* and an ink-storing-pipe-side bore 33*a* for allowing ink to pass therethrough when the tip 15 and the ink storing pipe 17 are fitted into the joint. The tip-side bore 37*a* and ink-storing-pipe-side bore 33*a* are communicated by a communicating hole 45 which is composed of a large-diameter portion 45*b* and a small-diameter portion 45*s* connected to the tip-side bore 37*a* and the ink-storing-pipe-side bore 33*a*, respectively and is made eccentric to the both bores 37*a* and 33*a*. A large ball 49 having a greater diameter than a bore diameter ls of the small-diameter portion 45*s* is disposed freely movably in at least a part of a space formed between the rear end of the tip 15 and the large diameter portion 45*b* when the tip 15 is fitted into the tip-side bore 37*a*. As the ball-point pen is thus constructed, if normal writing is done with the pen tip down, the large ball 49 moves toward the pen-tip-side end in the at-least-a-part of a space 47 to thereby make the communicating hole 45 open. Accordingly, the ink storing pipe 17 and the tip 15 is communicated, so that ink stored in the ink storing pipe 17 moves toward the tip 15 through the communicating hole 45. At that time, since the large ball 49 is placed freely movably in the at-least-a-part of the space 47, the ink from the ink storing pipe 17 moves toward the tip 15 through channels formed between the large ball 49 and the inner side of the large-diameter portion 45*b* as well as the inner side of the ink-storing-pipe-side bore 33*a*. At that time, since the large ball 49 is placed freely movably in the at-least-a-part of the space 47, the ink from the ink storing pipe 17 moves toward the tip 15 through small channels formed between the large ball 49 and the inner side of the large-diameter portion 45*b* or/and the inner side of the ink-storing-pipe-side bore 33*a*.

In contrast, when writing is done with the tip up, the large ball 49 moves toward the small-diameter portion 45*s* of the communicating hole 45 from the pen-tip-side end in the at-least-one-part of the space 47. As the large ball 49 has a greater diameter than the inside diameter ls of the small-diameter portion 45*s*, the large ball 49, reaching the small-diameter portion 45*s*, blocks the small-diameter portion 45*s*, so that the communicating hole 45 is closed. Accordingly, since the large ball 49 moves toward the small-diameter-portion 45*s* when upward writing is done, if the outside air flows into the refill 3 through micro-clearances between the writing micro-ball 13 held at the front end of the tip 15 and the tip 15, the ink storing pipe 17 is confined from the outside air, as if, for example, one opening of a straw with a liquid therein were sealed by a finger. Hence, it is possible to prevent back leakage phenomenon from occurring. In this way, the communicating hole 45 is provided for the joint 19 connecting the ink storing pipe 17 and the tip 15, and the large ball 49 is disposed freely movably within a passage of the communicating hole 45, which shifts from one site to the other of the passage in accordance with the downward use or the upward use of the ball-point pen 1 whereby the passage is opened or blocked. As a result, a back leakage preventing valve 61 as a back leakage protecting device is created inside the joint 19.

Besides, since the communicating hole is made eccentric to the tip-side bore and the ink-storing-pipe-side bore, improved flow of ink can be established when downward writing is done.

2) Since the joint 19 is constructed in a form of a hollow sleeve having a flange 31 in the middle portion with respect to the lengthwise direction of it and a half of the joint divided by the flange 31 has the ink-storing-pipe-side bore 33*a* and constitutes a squeezing pipe portion 33 to be squeezed into the front part of the ink storing pipe 17 while the other half divided by the flange 31 has the tip-side bore 37*a* and constitutes a fitting pipe portion 37 fitted to the mouthpiece 7, the flange 31 abuts the front end of the ink storing pipe 17 when the squeezing pipe portion 33 of the joint 19 is squeezed into the ink storing pipe 17 of the ball-point pen refill 3, whereby the joint 19 is positioned relative to the ink storing pipe 17.

Further, since a plurality of slant ribs 39 are formed between the fitting pipe portion 37 and the flange 31, the mouthpiece 7 has a stepped bore 57 formed thereinside by drilling in conically stepped formation and one ridge 57*a* at least one step 57*a* of steps 57*a*, 57*a*, . . . of the stepped bore 57 is engaged with the slant ribs 39 in a biting manner; it is possible for the tip 15 not to sway when the ball-point pen refill 3 with its ink storing pipe 17 of the ball-point pen refill 3 inserted in the hollow barrel 5 is fixed by the mouthpiece 7.

3) Since the joint 19 and the hollow barrel 5 are formed with a resin of the same color with ink used and a transparent resin, respectively, even if the ink is used up and the color of ink that used to be in the ink storing pipe 17 became unknown, it is possible to check the joint 19 of the same color with the ink through the transparent hollow barrel 5 from the outside. Accordingly, a user will never be puzzled to replace the used refill with a new ball-point pen refill 3 of the ink having the same color as in the used refill.

4) Since separate engaging portions 59*f*, 59*r* are formed at different sites with respect to the axial direction of the cap 11 on the inner peripheral surface thereof near to an opening thereof and one the engaging portion 59*f* is engaged with a receiving-side engaging portion 51*f* formed on the end of the mouthpiece 7 of the hollow barrel 5 while the other engaging portion 59*r* is engaged with another receiving-side engaging portion 51*r* provided on the end of tail-plug 9 of the same hollow barrel, the individual engaging portions 59*f*, 59*r* on the cap 11 are dedicatedly allotted to the receiving-side engaging portion 51*f* formed on the end of the mouthpiece 7 and the receiving-side engaging portion 51*r* formed on the end of the tail-plug 9, respectively. Therefore, it is possible to improve the durability of the engaging portions as compared to a cap 11 formed with a single engaging portion.

5) Since the inner side of the tip-side bore 37*a* is formed with a groove 37$a_1$, extending from the large-diameter portion 45*b* toward the tip 15, an increased amount of ink is supplied to the pen tip through the groove 37$a_1$ when normal writing is done with the pen tip down.

6) Since a follower 29 of a grease or an oil substance of a grease as a main component which moves inside the ink storing pipe 17 following ink stored in the ink storing pipe 17 is put in the ink storing pipe 17 so as to abut the rear surface 16*a* of the ink, it is possible for the follower 29 to prevent ink from evaporating and flowing out from the ink storing pipe 17 on the side of the tail-plug 9.

Further, when upward writing is done, if the writing micro-ball 13 used up the ink therearound to thereby create a space between the writing micro-ball 13 and the ink, the ink head would become high and the back leakage phenomenon would be liable to occur. However, since the follower 29 is placed on the rear surface 16*a* of the ink, it is possible to inhibit the back leakage phenomenon by virtue of the viscosity of the follower 29.

7) Since a follower rod 29*a* which has a smaller diameter than the inside diameter of the ink storing pipe 17 and the same specific gravity with that of the follower 29 is buried in the follower 29, it is possible to inhibit so-called liquid flapping due to impacts caused by falling etc. Besides, since the follower rod as to be a solid serves as a skeleton for the greasy follower rather akin to liquids, the follower itself is stabilized and consequently, it is possible to prevent the back leakage phenomenon as well as to prevent the ink from evaporating and flowing out in a more effective manner than when the follower 29 is used alone.

8) Since a thixotropic ink is used which presents a high viscosity in a static state where the ball-point pen 1 is unused but lowers its viscosity in a dynamic state where the ball-point pen 1 is used with the writing micro-ball 13 rotating on the surface of paper, even if, for example, the ball-point pen 1 without cap 11 is placed in a breast pocket with its tip up and the writing micro-ball 13 at the front end popping out from the pocket comes in touch with the collar etc., as if upward writing were done, a slight, limited rotation of the writing micro-ball 13 occurring when the writing micro-ball 13 comes in contact with the collar etc., is unlikely to cause back leakage phenomenon. Consequently, it is possible to prevent clothes and the like from being polluted.

On the other hand, in a case where downward writing is done, when the pressed state between the writing micro-ball 13 and the ball socket seat 23$a_1$ is released by the writing pressure and the writing micro-ball 13 rolls on an unillustrated paper surface, the thixotropic ink will be easily drawn out onto the paper surface. Consequently, the ball-point pen is considered as to be easy to handle.

(Second embodiment)

A ball-point pen 1A in accordance with a second embodiment shown in FIGS. 23 through 27 is different from the first embodiment only in that a tip 15A has a spring 63 as an elastic member inside a hollow holder 23A and in the structure of a joint 19A. Therefore, only the different points and elements relating to the different points will be described.

Figure 23:
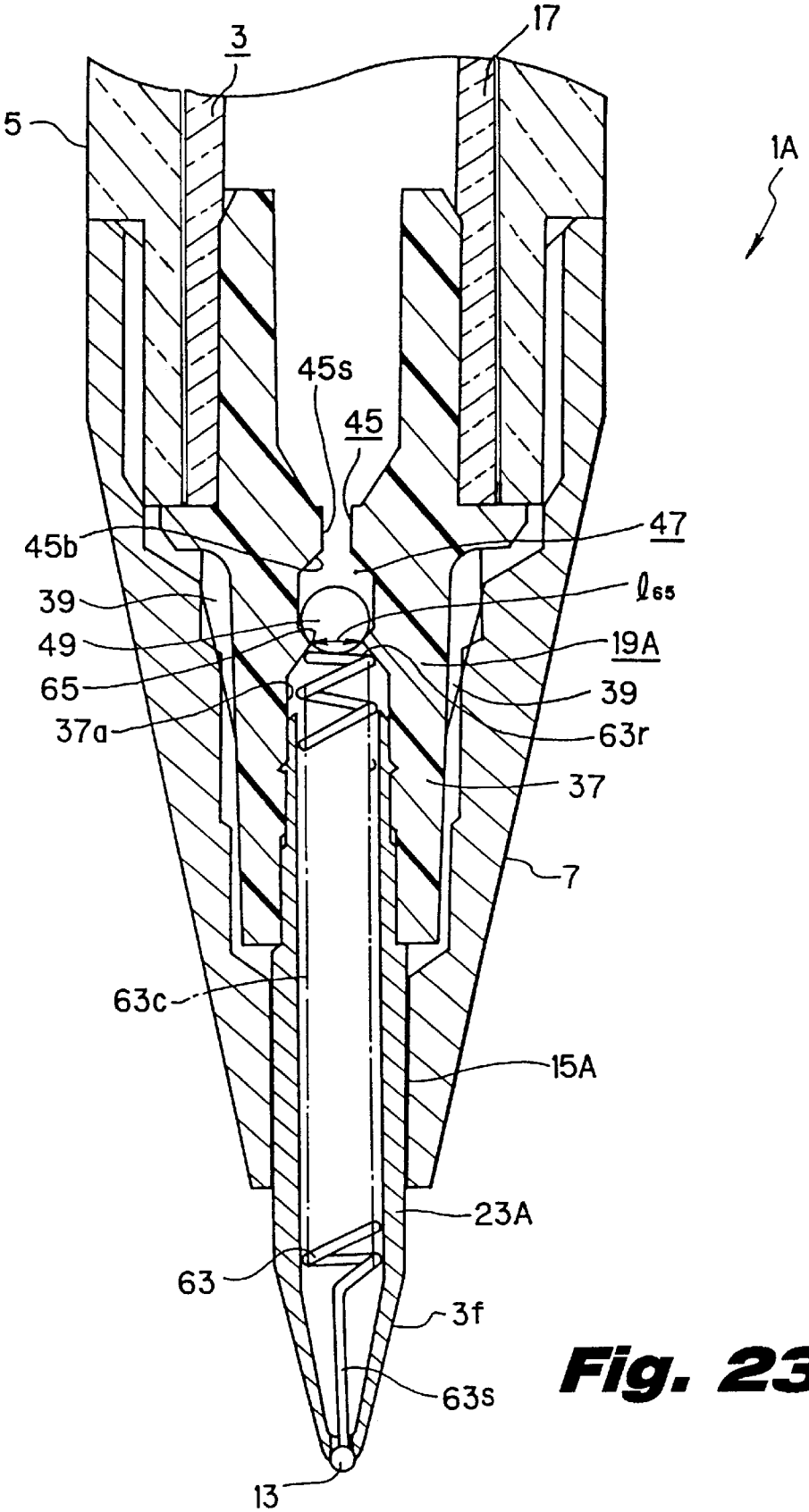
FIGS. 23 through 27 show a second embodiment of a ball-point pen of the present invention.
Figure 24:
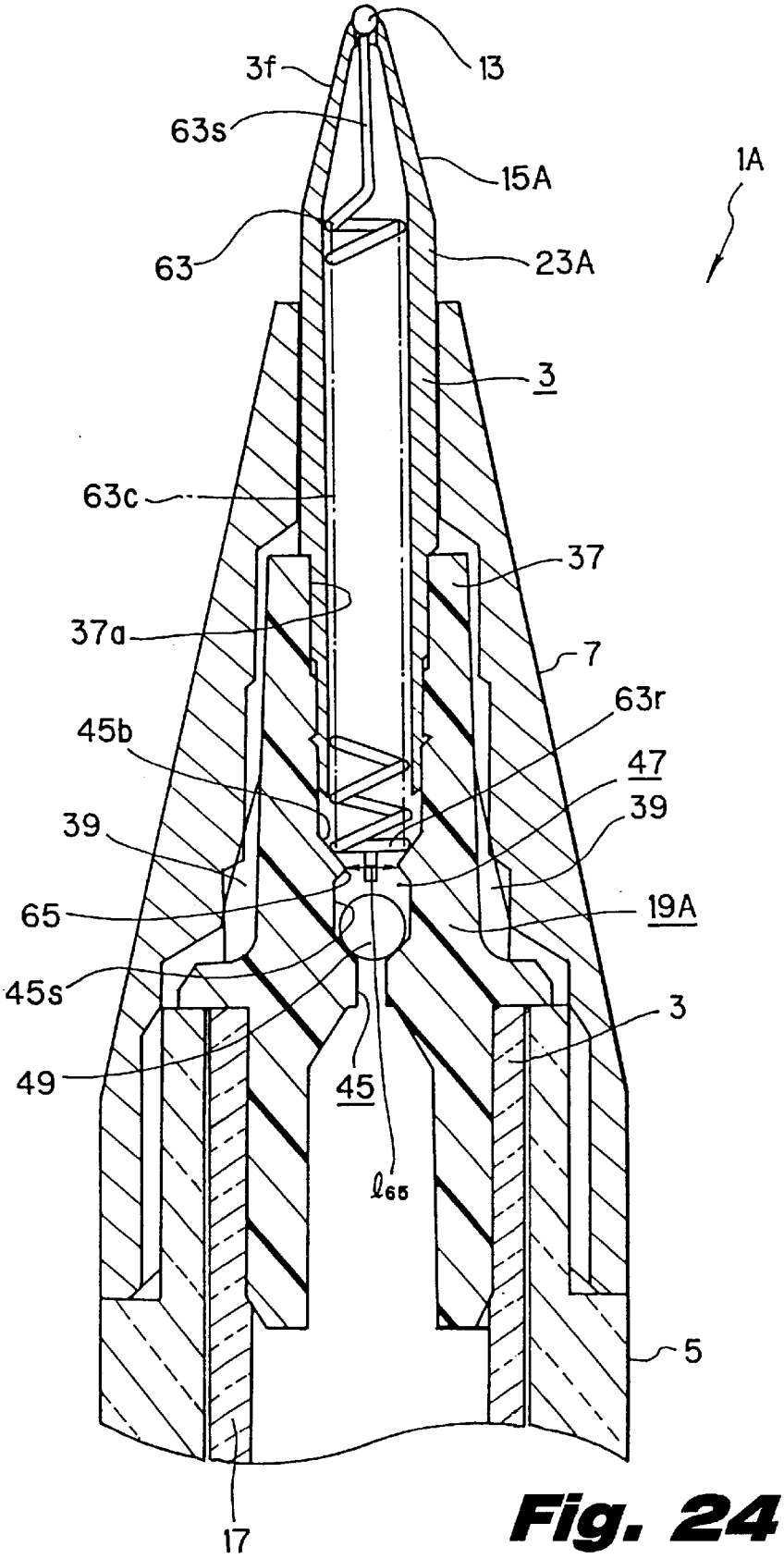

As shown in FIGS. 23 and 24, the tip 15A has a spring 63 accommodated in a hollow holder 23A. This spring 63 gives the writing micro-ball 13 an elastic force from the backside thereof.

The joint 19A is formed with a resiliently deformable synthetic resin. A narrow part 65 is formed between the large-diameter portion 45*b* as a component of the communicating hole 45 of the joint 19A and the tip-side bore 37*a*. The inside diameter $l_{65}$ of the narrow part 65 is set smaller than the diameter of the large ball 49.

Figure 25:
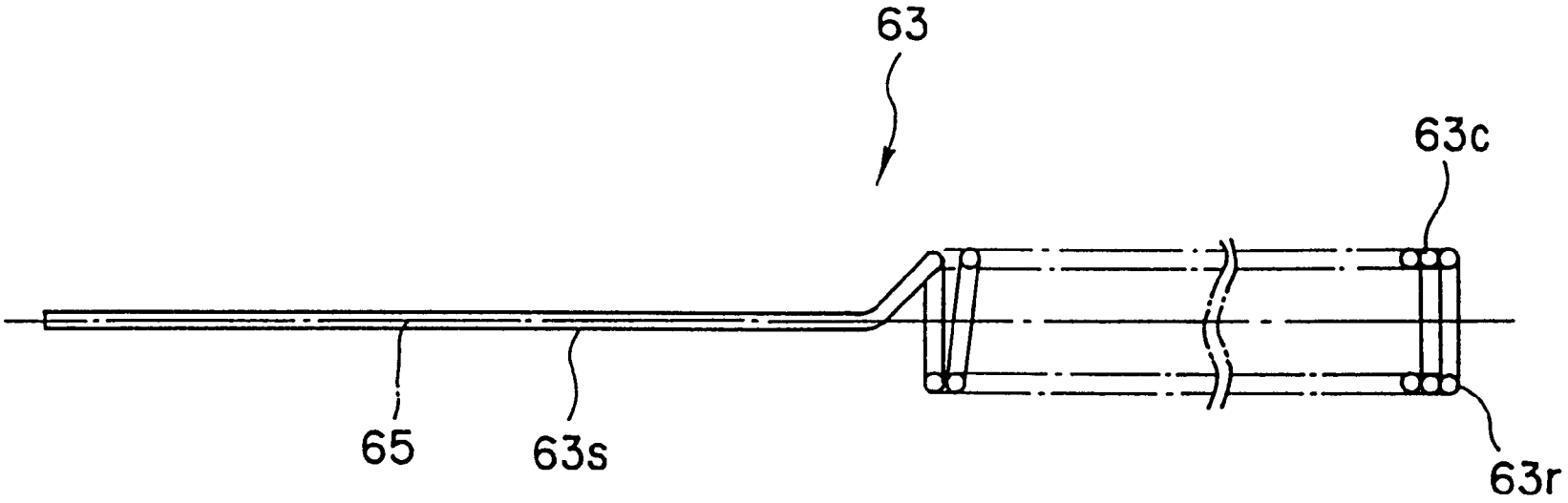

The spring 63 is formed, as shown in FIG. 25, by winding a steel material for springs into a cylindrical coil 63*c*, thereafter, bending the line toward a spring central axis 65 making an angle of about 45 degrees with the axis and creating a straight portion 63*s* that lies coaxially with the spring central axis 65.

Hence, according to the ball-point pen 1A of the second embodiment, the writing micro-ball 13 is abutted against the press-formed inner surface 23$a_1$ of the ball socket seat 23$a_1$ (see FIG. 12) by the elastic force of the spring 63 so that the micro-ball may not drop off from the ball socket seat 23$a_1$. Accordingly, it is possible to prevent occurrence of so-called forward leakage as to be the natural falling phenomenon due to the gravity acted on ink when the pen tip is down.

Figure 27:
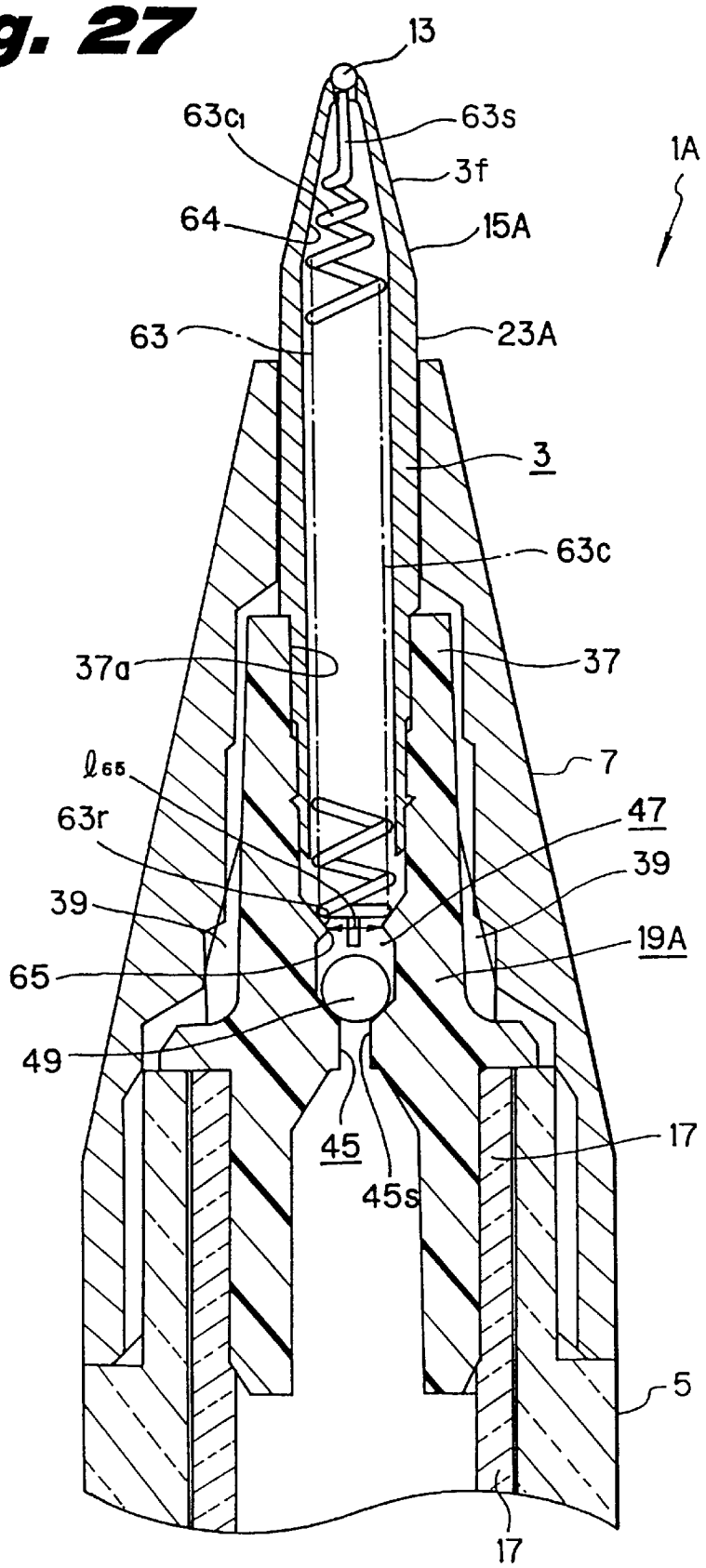

Further, as shown in FIG. 27, when the front end portion, designated at 63$c_1$, of the coil portion 63*c* of the spring 63 is tapered or formed into a conical shape so as to fit the shape of a front bore 64 of the hollow holder 23A, the stability of the spring 63 inside the hollow holder 23A is improved. Therefore, it is possible to establish a good contact between the writing micro-ball 13 and the spring 63.

Moreover, since the joint 19A is equipped with the narrow part 65 between the large-diameter portion 45*b* as a component of the communicating hole 45 of the joint 19A and the tip-side bore 37*a*, and is formed of a resiliently deformable synthetic resin, the narrow part 65 is easily expanded when the large ball 49 is inserted into the communicating hole 45 of the joint 19A. Hence, the assembling of the large ball 49 to the joint 19A can be easily done, and the improvement of the assembling work can be expected. Besides, since the inside diameter $l_{65}$ of the narrow part 65 is set smaller than the diameter of the large ball 49, the large ball 49 will not come out through the hole defined by the narrow part 65 toward the pen tip side. Accordingly, the large ball 49 inserted in the communicating hole 45 is freely movable within a space 47 defined by the narrow part 65 and the front end of the small-diameter 45*s* as a part of the communicating hole 45 near to the side of the large-diameter portion 45*b*. Further, since the narrow part 65 makes narrow the tip-side bore 37*a* near to the side of the large-diameter portion 45*b*, if the spring 63 to be inserted into the hollow holder 23 is designed to be somehow longer than the hollow holder 23 and the rear end 63*r* of the spring 63 is adapted to abut the narrow part 65 when the spring 63 is inserted into the tip-side bore 37*a* of the hollow holder 23, the spring 63 is contracted between the narrow part 65 and the writing micro-ball 13 that is prevented from falling off the ball socket seat 23$a_1$ by the press-formed part 23*a*, to thereby exert resilient forces. For this reason, the writing micro-ball 13 becomes pressed resiliently by the spring 63 all the time. At that time, if critical factors for determining the resilient force acted on the writing micro-ball 13, such as the length of the spring 63, the position of the narrow part 65 etc., are properly set up so that the resilient force on the writing micro-ball 13 may be weaker to some extent than the writing pressure required for writing, no harmful effect against writing does occur and this rather facilitates the pen to realize smooth, comfortable writing in conformity with the surface roughness of the paper.

(Third embodiment)

Figure 28:
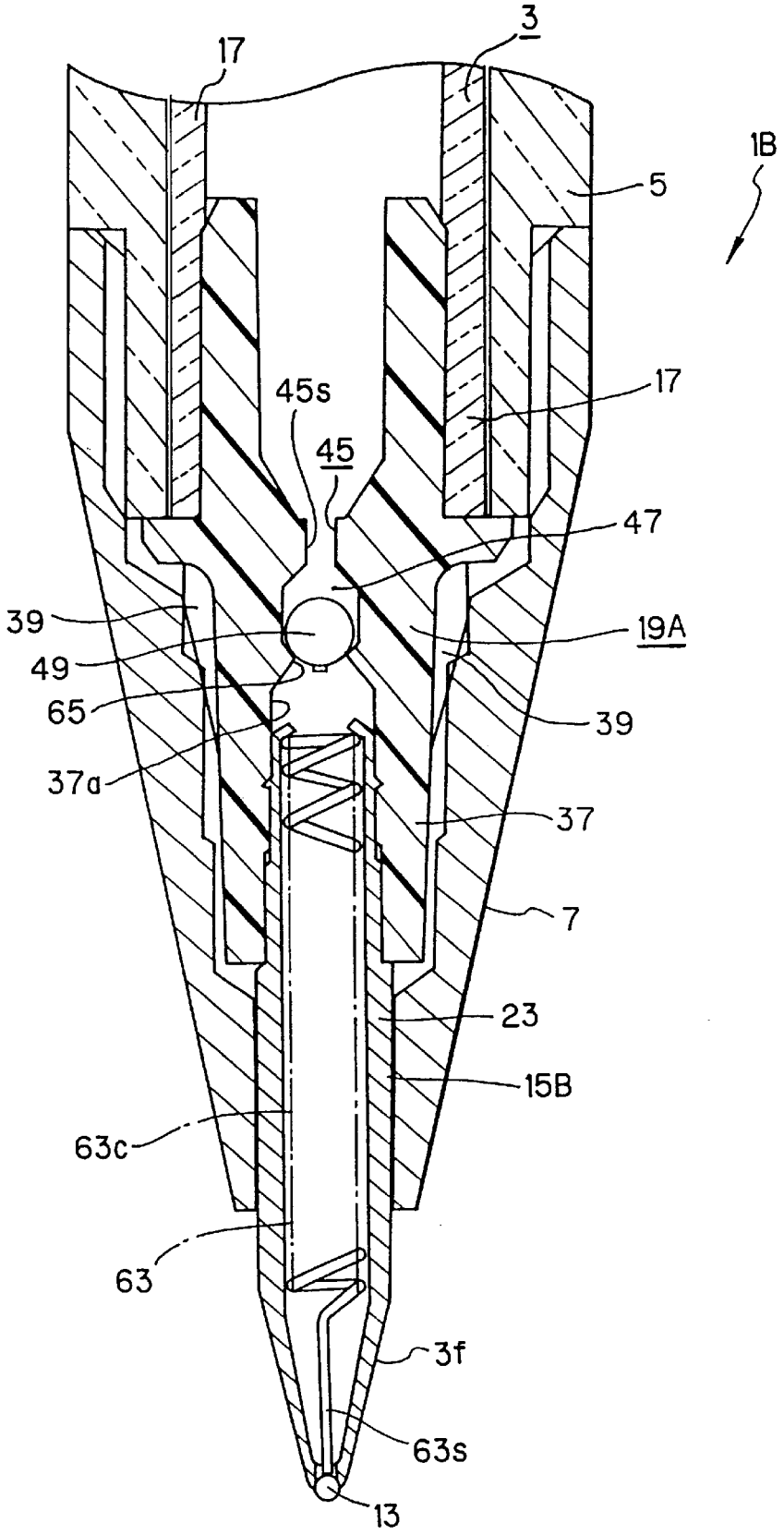
FIGS. 28 and 29 show a third embodiment of the present invention.
Figure 29:
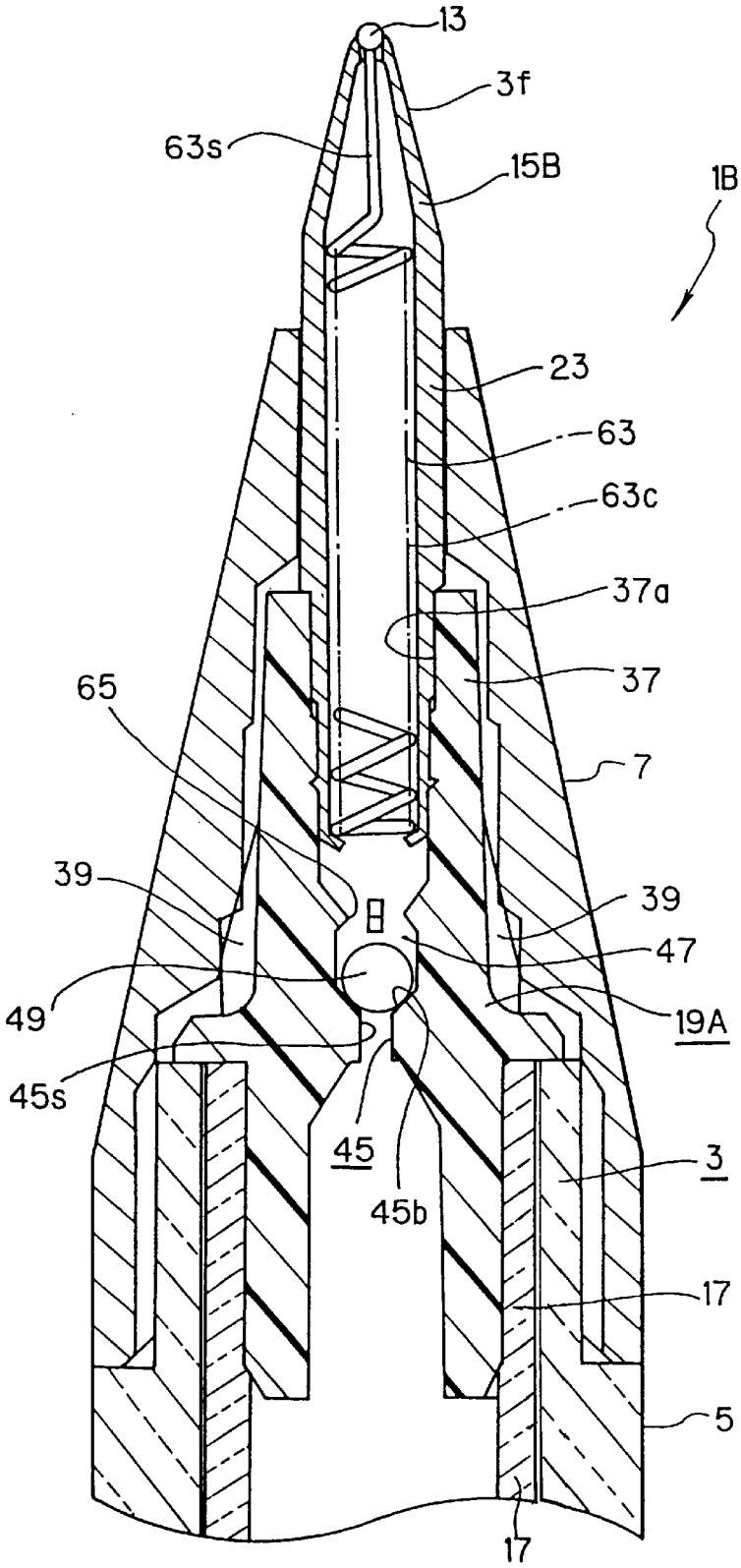

A ball-point pen 1B in accordance with a third embodiment shown in FIGS. 28 and 29 is different from the second embodiment only in that a tip 15B is produced by press-forming at least a part of the rear end of the hollow holder 23 after the spring 63 is inserted into the hollow holder 23. Accordingly, other identical elements will be assigned with the same reference numerals used in the first and second embodiment and the description will be omitted.

Hence, according to the ball-point pen 1B of the third embodiment, since, as shown in the aforementioned figures, the ball-point pen 1B has the tip 15B which is produced by press-forming at least a part of the rear end of the hollow holder 23 after the spring 63 is inserted into the hollow holder 23, the spring 23 will never pop out from the hollow holder 23 when the tip 15B is fitted into the tip-side bore 37*a* of the joint 19A. Accordingly, since no disturbance due to the spring 63 will occur when the tip 15B is assembled to the joint 19A, the assembling performance can be improved.

(Fourth embodiment)

Figure 30:
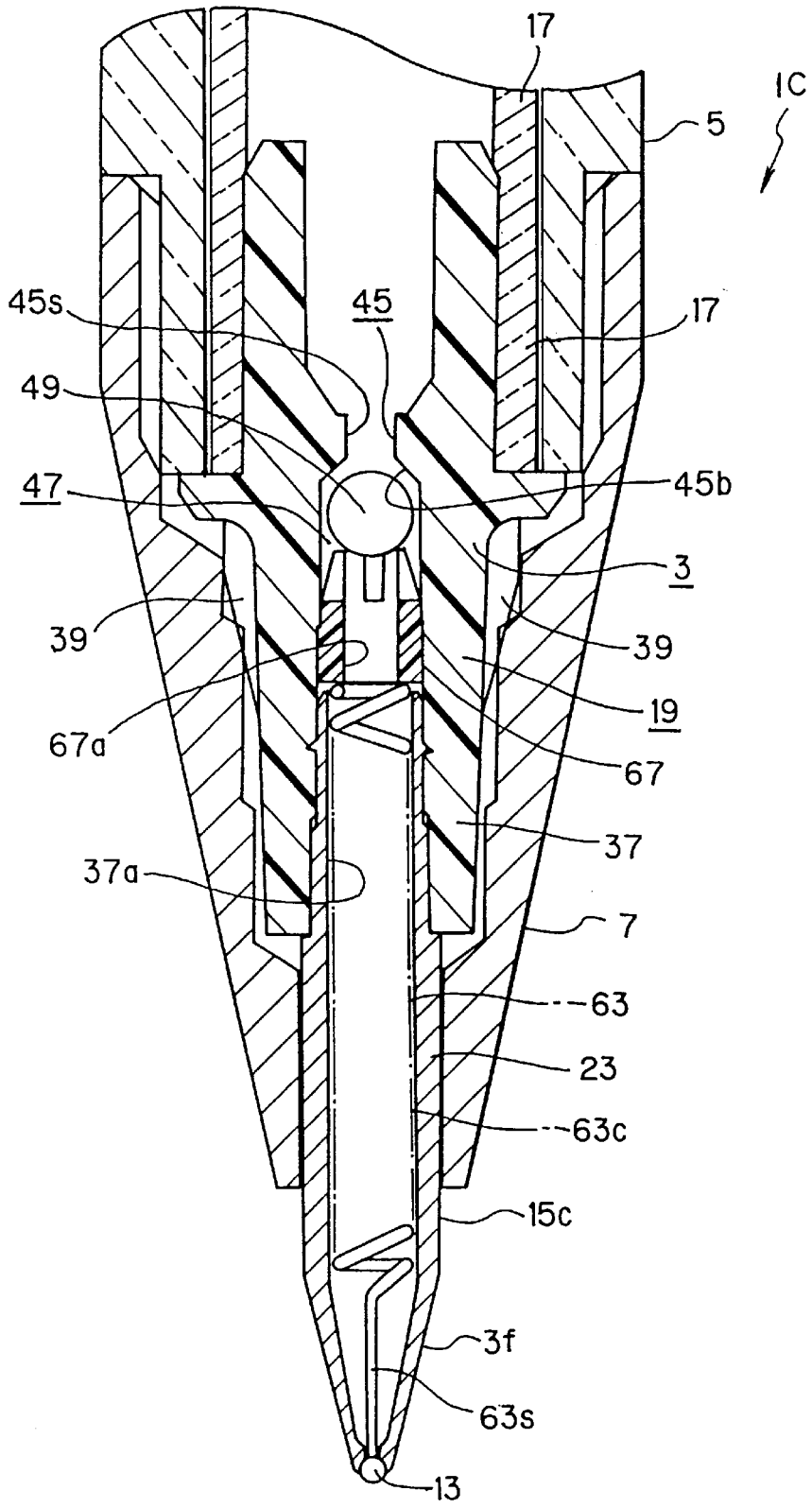
FIGS. 30 and 31 show a fourth embodiment of the present invention.
Figure 31:
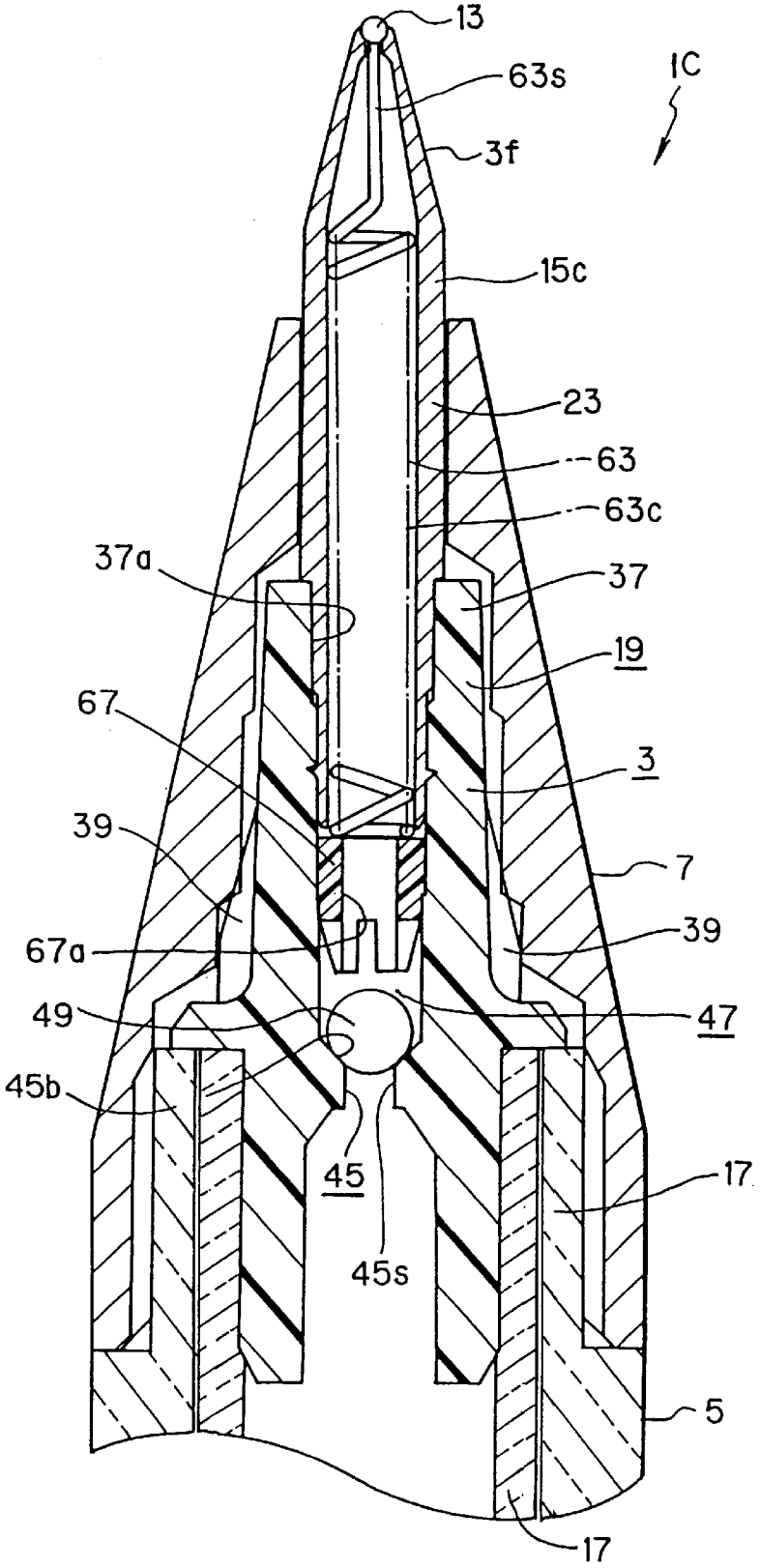

A ball-point pen 1C in accordance with a fourth embodiment shown in FIGS. 30 and 31 has a piece 67 having an ink channel 67*a* thereinside fixed between a tip 15C in the tip-side bore 37*a* and the large-diameter portion 45*b* of the communicating hole 45, in place of the narrow part 65 in the joint in the second and third embodiments.

Hence, according to the fourth embodiment, the large ball 49 moves freely in a space 47 defined by the front end of the small-diameter 45*s* as a part of the communicating hole 45 near to the side of the large-diameter portion 45*b* and the piece 67. Accordingly, when normal writing is done with the pen tip down, the ink stored in the ink storing pipe 17 moves toward the tip 15C through the ink channel 67*a* inside the piece. Since the arrangement of the piece 67 in the tip-side bore 37*a* defines the range within which the large ball 49 is freely movable, the tip-side bore 37*a* is formed in more simplified manner since there is no need for creating a narrow part, than the process in the aforementioned second or third embodiment where the large ball 49 is allowed to freely move in a range between the narrow part 65 and the front end of the small-diameter 45*s* of the communicating hole 45 near to the side of the large-diameter portion 45*b*.

(Fifth embodiment)

Figure 26:
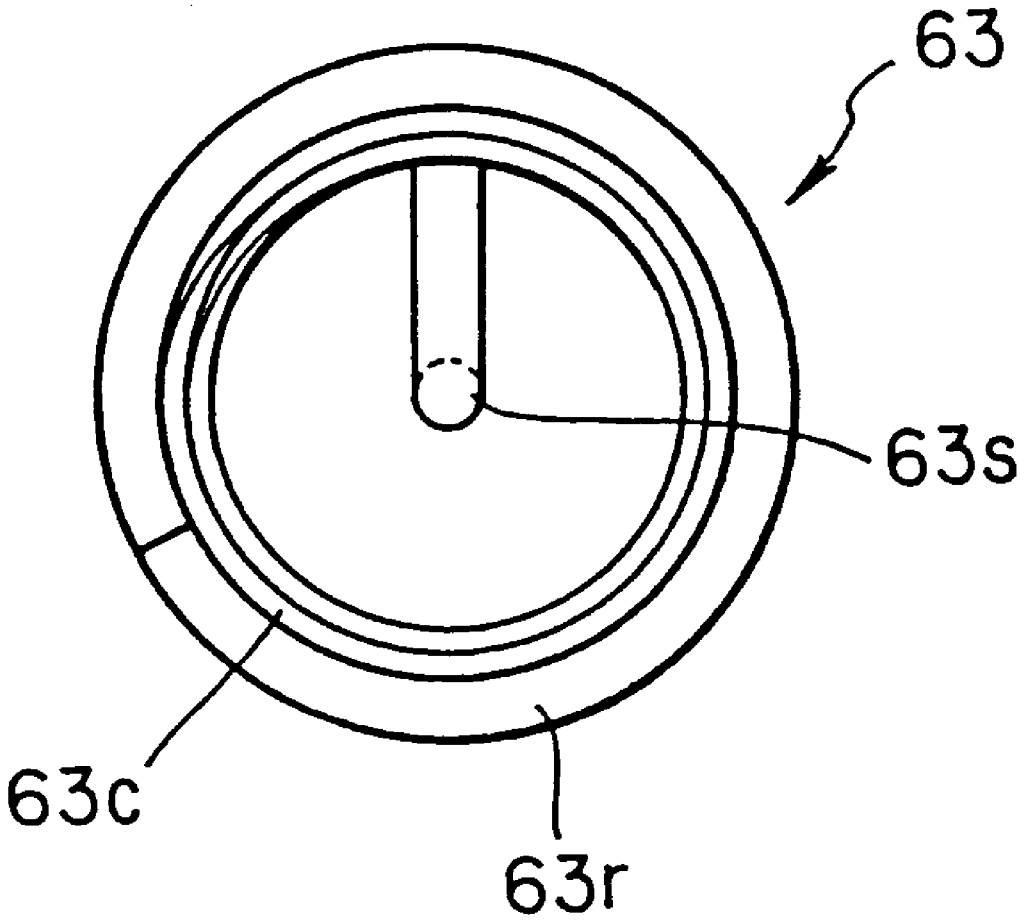
Figure 32:
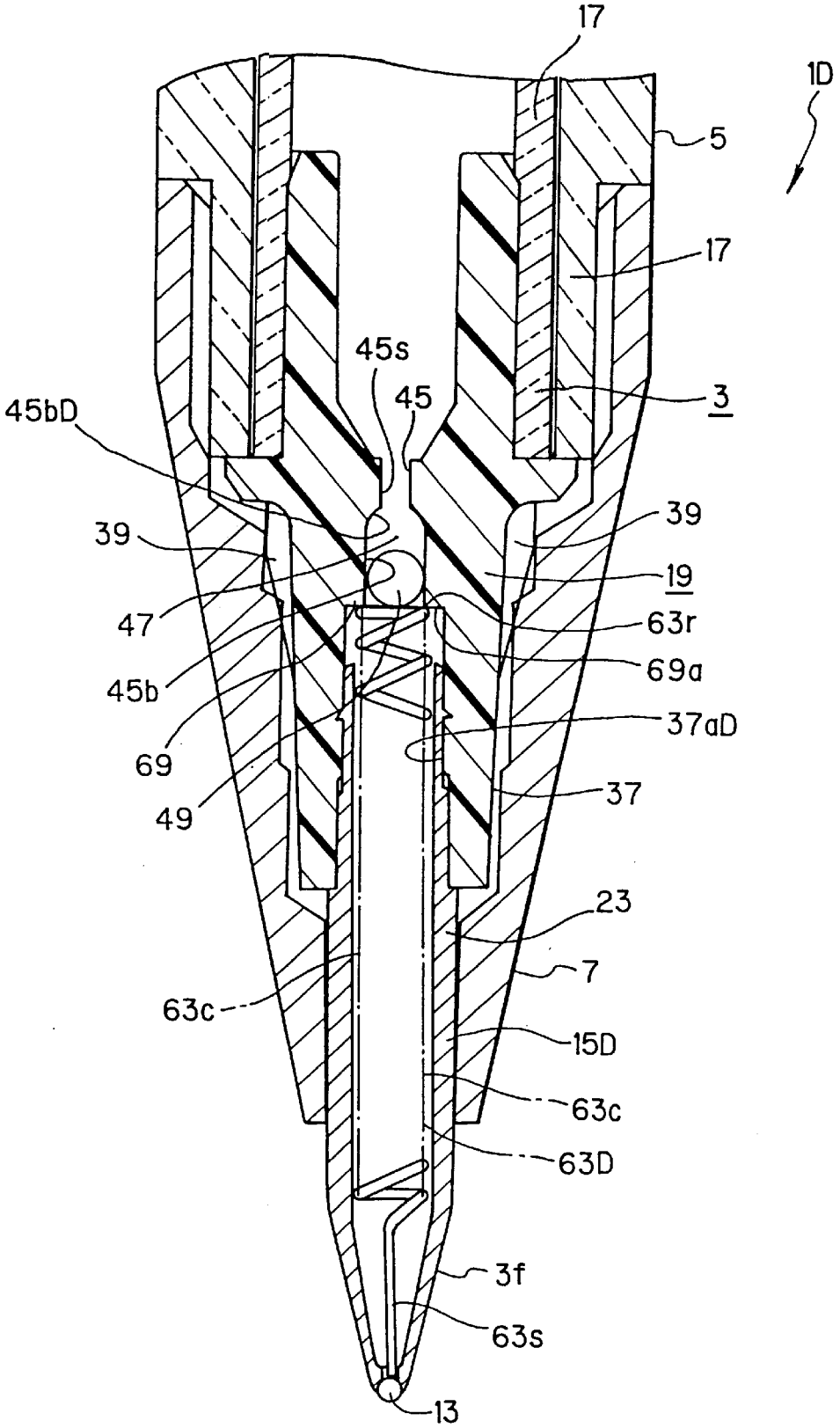
FIGS. 32 through 35 show a fifth embodiment of the present invention.
Figure 33:
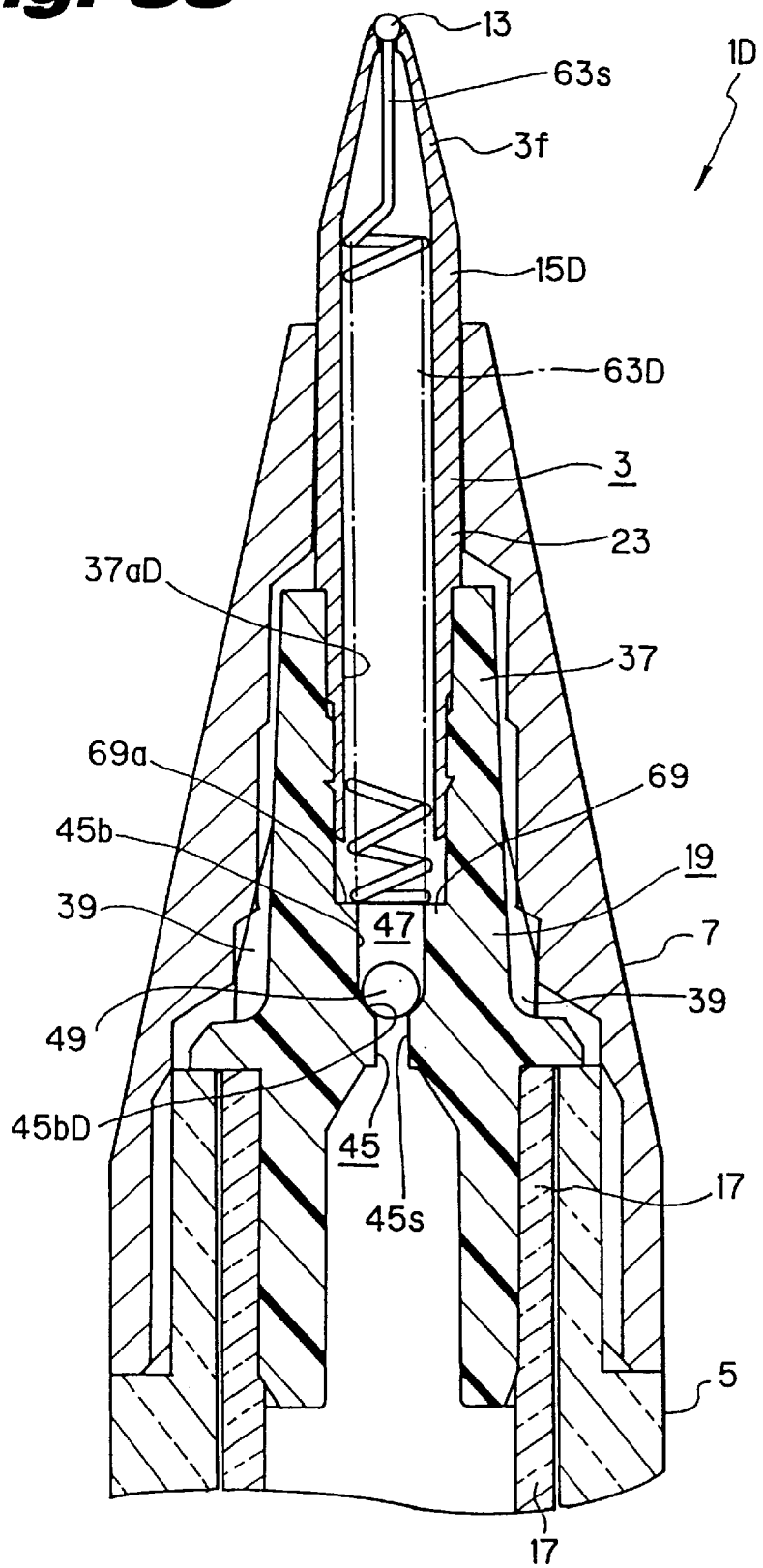
Figure 34:
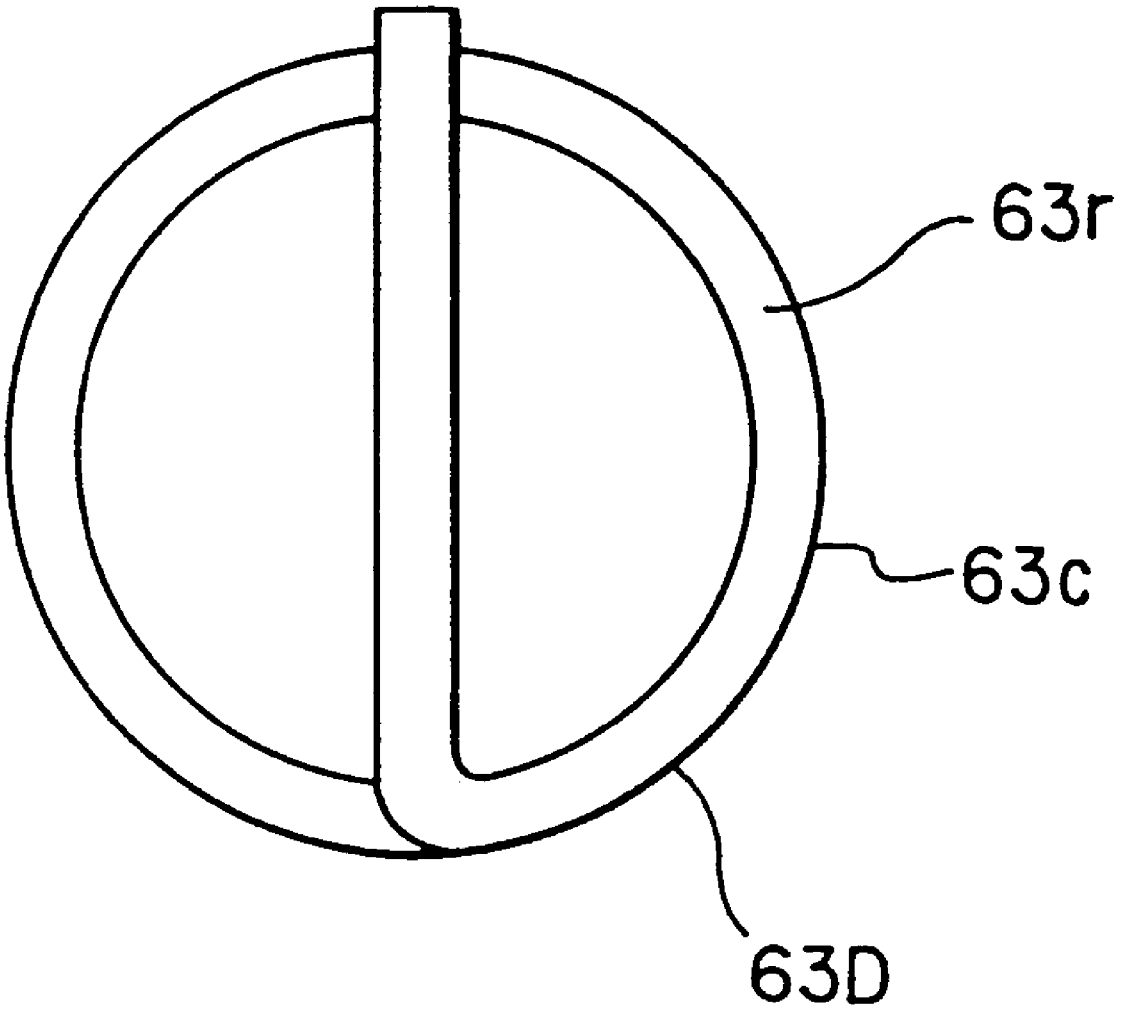

A fifth embodiment shown in FIGS. 32 through 35, is different in the spring and tip-side bore from each of the aforementioned embodiments. That is, the spring 63 shown in FIGS. 25 and 26 is replaced with another spring 63D which has a longer than the hollow holder 23 and is formed by bending the rear end 63*r* of the coil portion 63*c* so that the bent end may be in parallel with a diameter of the coil portion 63*c* as shown in FIG. 34. Further, a tip-side bore having a greater diameter than that of a hemispherical large-diameter portion 45*b*D is formed as shown in FIGS. 32 and 33 and this is designated at 37*a*D. As stated, since the tip-side bore 37*a*D is formed greater in diameter, a stepped portion 69 is formed in the boundary section between the tip-side bore 37*a*D and the large-diameter portion 45*b*D. Then, a tip 15D with the spring 63D inserted therein is fitted into the tip-side bore 37*a*D to thereby form a ball-point pen 1D. Here, a reference numeral 69*a* designates a footstep surface formed by the stepped portion 69 facing the tip-side bore 37*a*D. The rear end 63*r* of the spring 63 abuts this surface.

Thus, as shown in FIGS. 32 and 33, when the tip 15D is fitted into the tip-side bore 37*a*D, the rear end 63$c_1$, of the spring 63D abuts the footstep surface 69*a* of the stepped portion 69, and the spring 63D is contracted between the footstep surface and the writing micro-ball 13 to produce resilient forces. Hence, the writing micro-ball 13 becomes pressed resiliently all the time. At that time, if critical factors for determining the resilient force acted on the writing micro-ball 13, such as the length of the spring 63D, the position of the footstep surface 69*a* etc., are properly set up so that the resilient force on the writing micro-ball 13 may be weaker to some extent than the writing pressure required for writing, no harmful effect against writing does occur and this rather facilitates the pen to realize smooth, comfortable writing in conformity with the surface roughness of the paper.

Since the rear end 63*r* of the coil portion 63*c* is bent so as to be parallel to a diameter of the coil portion 63*c*, when downward writing is done, the large ball 49 abuts the rear end 63*r* of the coil portion 63*c*, so that the movement of the large ball 49 is limited. Accordingly, the large ball 49 will freely move in a space 47 formed by the bent rear end 63*r* and the aforementioned large-diameter portion 45*b*D.

Figure 35:
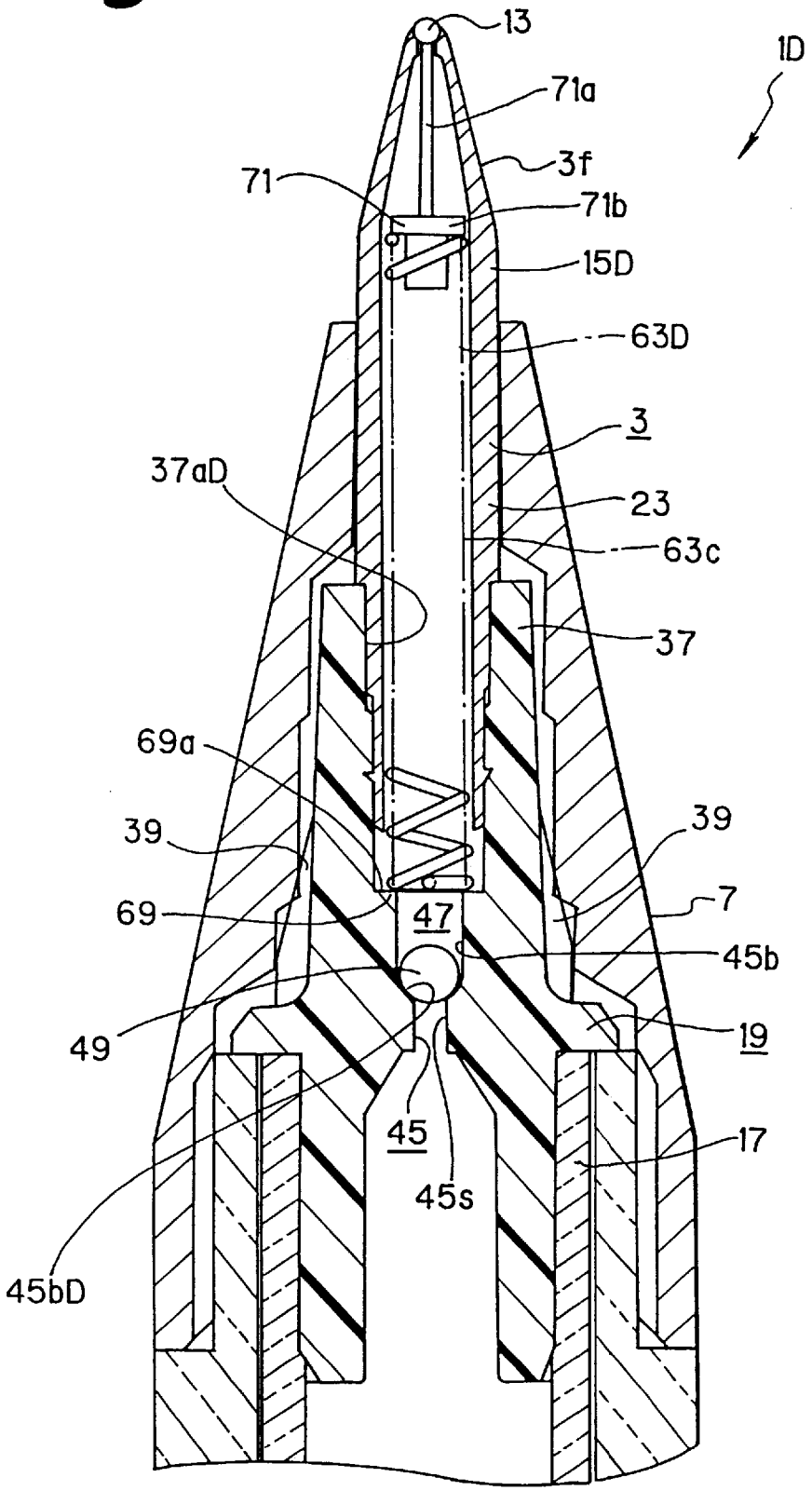

A separate, pushing rod member 71 composed of a rod portion 71*a* abutting the writing micro-ball 13 and a base 71*b* connected to the spring 63D may be attached to the front end of the spring 63D as shown in FIG. 35. In this case, because the base 71*b* is able to move relative to the spring 63D, the swaying tolerance of the rod portion 71*a* improves, therefore it is possible to realize a good fit between the writing micro-ball 13 and the rod portion 71*a*.

Figure 36:
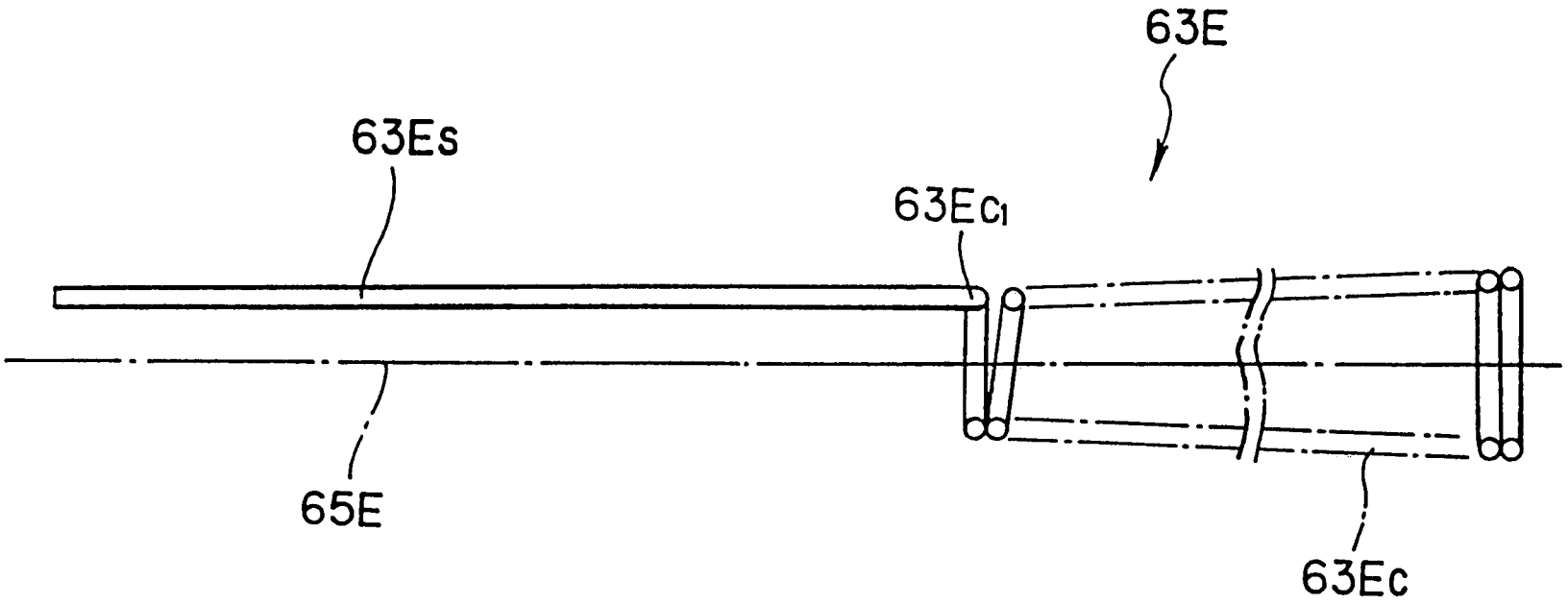
FIGS. 36 and 37 show the wholly variated springs shown in the second through fifth embodiments.
Figure 37:
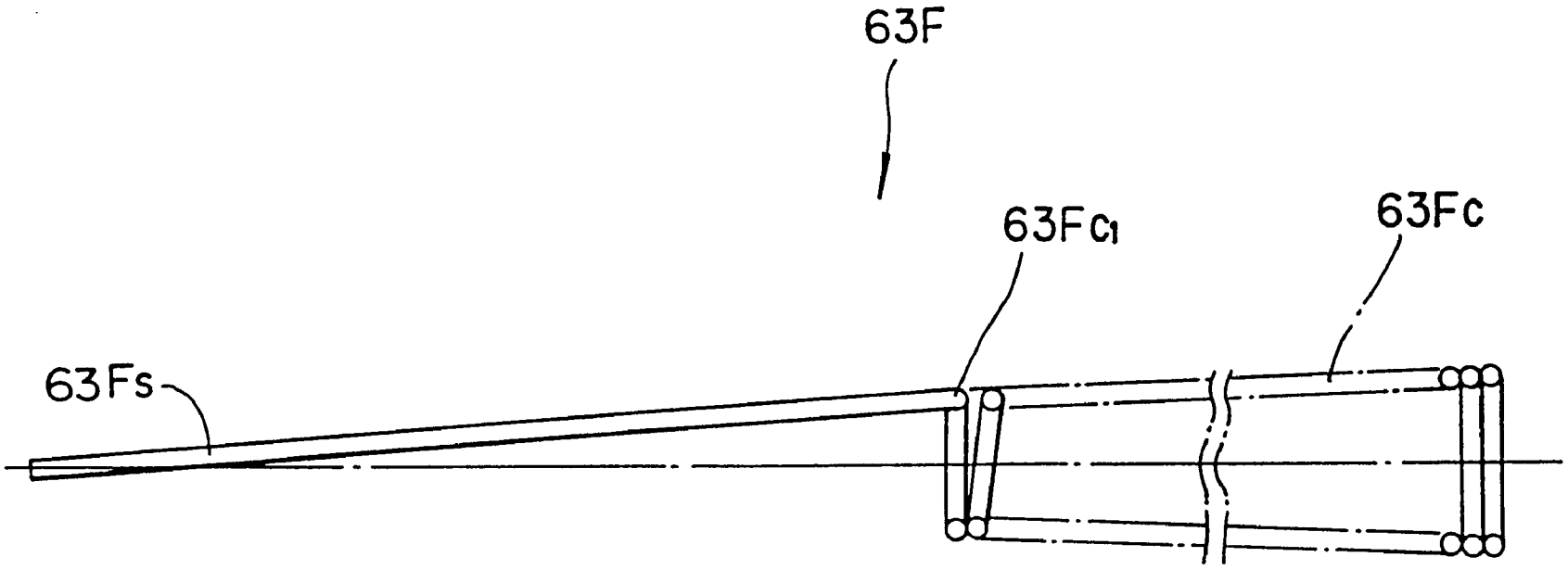

Other than the springs used in the aforementioned embodiments, springs shown in FIGS. 36 and 37 can be applied.

A spring 63E shown in FIG. 36 is composed of a frustum coil portion 63Ec having easy slope and a straight portion 63Es abutting the writing micro-ball 13. The straight portion 63Es is extended from a front end 63Ec$_1$ of the coil portion 63Ec in parallel with a central axis 65E.

A spring 63F shown in FIG. 37 has a coil portion 63Fc which is identical in shape with the coil portion 63Ec of the spring 63E, but has a different straight portion 63Fs. Specifically, the straight portion 63Fs extends from a front end 63Fc$_1$ of the coil portion 63Fc toward the writing micro-ball 13 held by the ball socket seat 23$a_1$ in the hollow holder 23 when the spring 63F is inserted into the hollow holder 23. Therefore, even if the hollow holder 23 is formed with a conically stepped bore, the spring becomes hard to be caught by the hollow holder 23. As a result, the workability of assembling the spring 63F to the hollow holder 23 improves.

Figure 38:
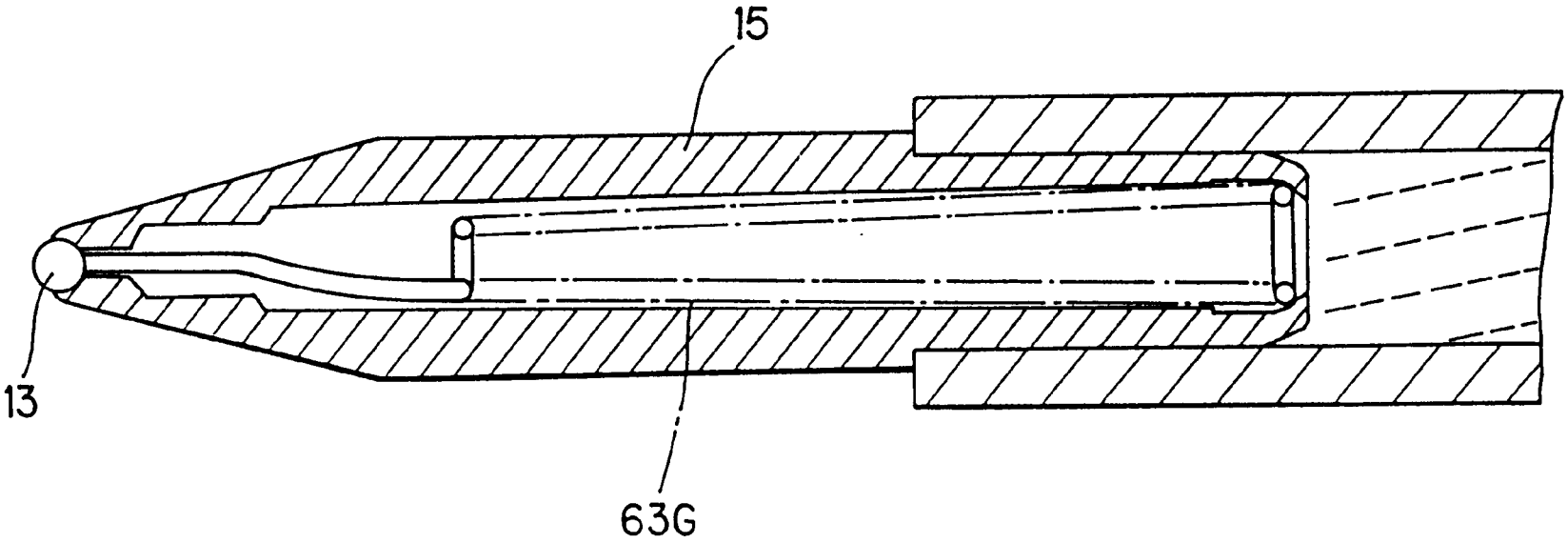
FIG. 38 is a view of a ball-point pen to which a third wholly variated spring is applied in which a straight part of the spring is gently cranked.
Figure 39:
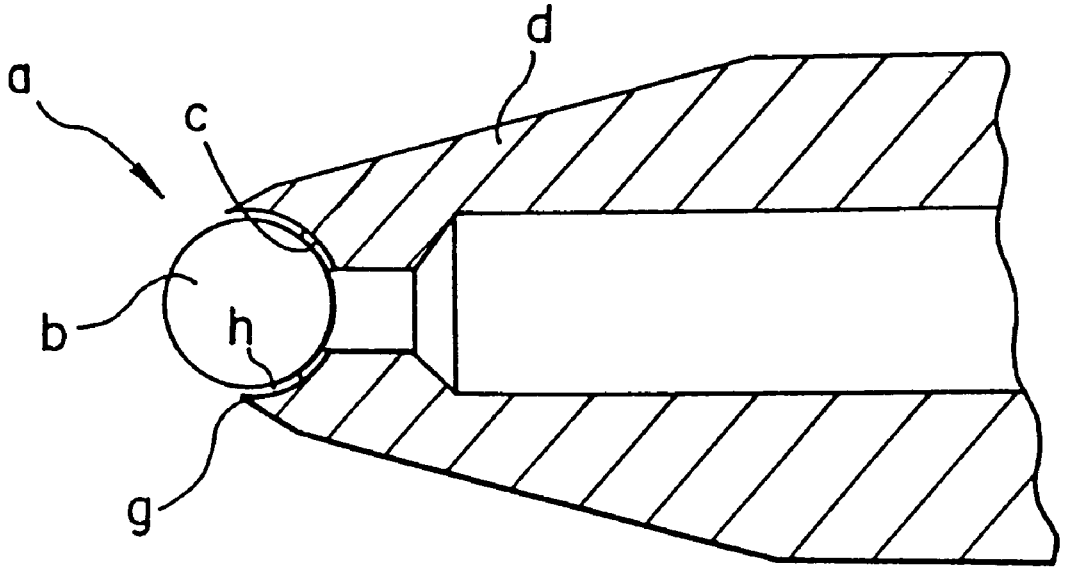
FIG. 39 is a view showing a structure of a typical tip for illustrating the background art.

As a variational example of the spring 63F, a spring 63G in which the straight portion 63Fs is cranked in the middle as shown in FIG. 38 may present the same effect.

INDUSTRIAL APPLICABILITY

As has been stated, the ball-point pen according to the present invention is able to effectively prevent the back leakage phenomenon which is liable to occur when upward writing is done.

We claim:

1. A ball-point pen and cap comprising:

a hollow barrel having a mouthpiece-side end, a tail-plug-side end and an outer peripheral surface;

a cap having an opening aligned axially about a longitudinal axis, and an inner peripheral surface, said cap adapted to be selectively fitted onto either end of said hollow barrel;

at least two engaging portions formed on the inner peripheral surface of said cap, each of said cap engaging portions having an engaging surface, and each of said cap engaging portions being disposed at different locations along the longitudinal axis of said cap;

a first receiving-side engaging portion formed on the outer peripheral surface of said hollow barrel near the mouthpiece-side end; and a second receiving-side engaging portion formed on the outer peripheral surface of said hollow barrel near the tail-plug-side end;

wherein a first of said cap engaging portions is adapted to engage said receiving-side engaging portion formed on the mouthpiece-side end of said hollow barrel and a second of said cap engaging portions is adapted to engage said receiving-side engaging portion formed on the tail-plug-side end of said hollow barrel, said first cap engaging portion having its said engaging surface disposed radially outward from said longitudinal axis relative to said engaging surface of said second cap engaging portion.

* * * * *